United States Patent [19]

Weiler et al.

[11] Patent Number: 4,989,649

[45] Date of Patent: Feb. 5, 1991

[54] FILL MACHINE STERILIZATION PROCESS

[75] Inventors: Gerhard H. Weiler, Barrington; Arjun Ramrakhyani, Northbrook; Paul A. Anderson, Arlington Heights; Frank N. Leo, Crystal Lake, all of Ill.

[73] Assignee: Automatic Liquid Packaging, Inc., Woodstock, Ill.

[21] Appl. No.: 407,341

[22] Filed: Sep. 14, 1989

[51] Int. Cl.[5] ..... B65B 55/00

[52] U.S. Cl. ..... 141/1; 141/9; 141/85; 141/91; 134/8; 134/30; 137/241; 222/148

[58] Field of Search ..... 141/1, 4, 9, 85, 89, 141/90, 91, 92; 134/8, 18, 21, 22.1, 22.11, 22.15, 30; 137/241; 222/148

[56] References Cited

U.S. PATENT DOCUMENTS

| | | | |
|---|---|---|---|
| 2,787,875 | 4/1957 | Johnson | 141/91 X |
| 3,650,678 | 3/1972 | Hansen | 137/241 X |
| 3,791,424 | 2/1974 | Strople et al. | 141/92 |
| 3,850,207 | 11/1974 | Loliger et al. | 141/90 |
| 3,912,535 | 10/1975 | Rauser | 134/22.15 |
| 4,218,265 | 8/1980 | Fuchs et al. | 134/18 |
| 4,347,877 | 9/1982 | Hoiss | 141/91 |
| 4,353,398 | 10/1982 | Weiler et al. | 141/91 |
| 4,502,614 | 3/1985 | Weiler et al. | 222/148 |
| 4,623,516 | 11/1986 | Weiler et al. | 141/91 X |

*Primary Examiner*—Ernest G. Cusick

*Attorney, Agent, or Firm*—Dressler, Goldsmith, Shore, Sutker & Milnamow, Ltd.

[57] ABSTRACT

A sterilizing method is provided for use with a container filling machine having components defining passages through which a fluid product flows. In one method aspect, sterilizing steam is passed through the components unitl the components have been sterilized. As the system cools and the steam condenses, the system is pressurized with gas to prevent the internal pressure in the system from decreasing below the ambient atmospheric pressure. In a further method aspect, the sterilizing process is controlled in response to sensing the temperature of one or more of the components. In yet another aspect, a common source of sterilizing steam is provided for being directed into the product filling system and simultaneously into an associated process gas supply system to sterilize both systems generally concurrently in a single pass.

20 Claims, 24 Drawing Sheets

Fig. 3

| | |
|---|---|
| Fig. 3a | Fig. 3b |
| Fig. 3c | Fig. 3d |

Fig. 4

| | |
|---|---|
| Fig. 4a | Fig. 4b |
| Fig. 4c | Fig. 4d |

Fig. 5

| | |
|---|---|
| Fig. 5a | Fig. 5b |
| Fig. 5c | Fig. 5d |

Fig. 6

| | |
|---|---|
| Fig. 6a | Fig. 6b |
| Fig. 6c | Fig. 6d |

Fig. 7

| |
|---|
| Fig. 7a |
| Fig. 7b |

Fig. 8

| | | |
|---|---|---|
| Fig. 8a | Fig. 8b | Fig. 8c |

Fig. 7a

| VALVE | LOCATION | PART NUMBER | MANUAL OR AUTO | Y-YES N-NO CONTROL BY OPERATOR | INDEPENDENT LAST USED PILOT VALVE NUMBER | AUTOMATIC STERILIZATION CYCLE | | | | | | | | | | | | | |
|---|---|---|---|---|---|---|---|---|---|---|---|---|---|---|---|---|---|---|---|
| | | | | | | INTIAL CONDITIONS 010 | STEAM SUPPLY ON 020 | START AUTO CYCLE 030 | TD1=30 SEC. 040 | T/C #2 .GE. 220 F 050 | T/C #10 .GE. 220 F 060 | CRITICAL T/C .GE. 250 F 070 | TD2=30 MIN. 080 | TD3=30 SEC. 090 | TD4=2 MIN. 100 | TD5=30 MIN. 110 | TD6=1 MIN. 120 | OPERATOR "END CYCLE" 130 | TD7=30 SEC. 140 |
| 1 | STEAM INLET | BY CUSTOMER | M | – | – | X | O | | | | | | | | | | | | |
| 2 | STEAM SUPPLY | 624-37-619 | A | N | 1 | X | | | O | | | | X | | | | | | |
| 3 | FOLLOW-UP AIR SUPPLY | 624-37-619 | A | N | 2 | X | | | | | | | | O | | | | X | |
| 4 | MOTORIZED VALVE | 624-37-600 | A | N | D | X | | | O | | | | X | O | | | | X | |
| 5 | STEAM TO PRODUCT | 503-61-617 | M | – | – | O | | | | | | | | | | | | | |
| 6 | PRODUCT SUPPLY | BY CUSTOMER | M | – | – | X | | | | | | | | | | | | | |
| 7 | PRODUCT SHUT-OFF #1 | 624-07-600 | M | – | – | O | | | | | | | | | | | | | |
| 8 | PRODUCT FILTER #1 DRAIN | 624-37-612 | A | N | 3 | X | | O | | | | | | | X | | | | |
| 9 | PRODUCT FILTER #1 TEST AIR | 624-37-612 | A | Y | 4 | X | | O | | | | | | | | | | | X |
| 10 | PRODUCT FILTER #1 VENT | 624-37-616 | A | Y | 5 | X | | O | | X | | | | | | | | | |
| 11 | BIOBURDEN SAMPLE | 503-06-614 | M | – | – | X | | | | | | | | | | | | | |
| 12 | TEST AIR FILTER VENT | 624-37-612 | A | Y | 6 | X | | O | | | | | | | | | | | X |
| 13 | TEST AIR FILTER DRAIN | 624-37-612 | A | N | 7 | X | | O | | X | | | | | | | | | |
| 14 | PRODUCT SHUT-OFF #2 | 624-07-600 | M | – | – | O | | | | | | | | | | | | | |
| 15 | BARRIER STEAM | 624-37-615 | M | – | – | X | | | | | | | | | | | | | |
| 16 | PRODUCT FILTER #2 DRAIN | 624-37-616 | A | N | 8 | X | | O | | | | | | | | X | | | |

Fig.7b

| | | | | | | | | | | | | | | | | | | | |
|---|---|---|---|---|---|---|---|---|---|---|---|---|---|---|---|---|---|---|---|
| 17 | PRODUCT FILTER #2 TEST AIR | 624-37-612 | A | Y | 9 | X | | O | | | | | | | | | | | X |
| 18 | PRODUCT FILTER #2 VENT | 624-37-616 | A | Y | 10 | X | | O | | X | | | | | | | | | |
| 19 | BLOW/FILL VENT | 624-37-614 | A | N | 15 | R | | S | | | | | | | | | | | R |
| 20 | BLOW FILTER AIR/STEAM | 624-37-613 | A | N | 12 | R | | S | | | | | | | | | | | R |
| 21 | BLOW FILTER DRAIN | 624-37-612 | A | N | 13 | X | | O | | | | | | | X | | | | |
| 22 | JUNCTION VALVE | 624-37-611 | A | N | 11 | R | | S | | | | | | | | | | | R |
| 23 | BALLOON FILTER AIR/STEAM | 624-37-613 | A | N | 12 | R | | S | | | | | | | | | | | R |
| 24 | BALLOON FILTER DRAIN | 624-37-612 | A | N | 13 | X | | O | | | | | | | X | | | | |
| 25 | BALLOON FILTER RUN/STEAM | 624-37-613 | A | N | 15 | R | | S | | | | | | | | | | | R |
| 26 | SHIELD FILTER AIR/STEAM | 624-37-613 | A | N | 12 | R | | S | | | | | | | | | | | R |
| 27 | SHIELD FILTER DRAIN | 624-37-612 | A | N | 13 | X | | O | | | | | | | X | | | | |
| 28 | | | | | | | | | | | | | | | | | | | |
| 29 | STEAM CUP DRAIN | 624-37-620 | A | N | 14 | X | | O | | | X | | | O | | | X | | |
| 30 | COOLING WATER INLET | 503-34-603 | A | N | D | X | | O | | | | | | | | | X | | |
| 31 | AIR INLET | BY CUSTOMER | M | — | — | O | | | | | | | | | | | | | |
| 32 | SHIELD AIR SUPPLY | 501-40-686 | M | — | — | X | | | | | | | | | | | | | |
| 33 | AIR/NITROGEN SELECTOR | 624-37-646 | M | — | — | | | | | | | | | | | | | | |
| 34 | | | | | | | | | | | | | | | | | | | |
| 35 | | | | | | | | | | | | | | | | | | | |
| 36 | | | | | | | | | | | | | | | | | | | |
| 37 | | | | | | | | | | | | | | | | | | | |
| 38 | | | | | | | | | | | | | | | | | | | |
| 39 | | | | | | | | | | | | | | | | | | | |
| — | PRODUCT FILL VALVES (MACH.) | | A | — | | O | | | | | | | | | | | | | |

D=DIRECT ELECTRICAL ACTUATION

X=CLOSED
O=OPEN
R=RUN POSITION
S=STEAM POSITION

#14
PV #14
S-74
#15
PV #15
S-75
#16
PV #16
S-76
#3
PV #3
S-63
#4
PV #4
S-64
B
A
X
29
STEAM CUP DRAIN
8
9
19
BLOW/FILL VENT
25
BALLOON FILTER RUN/STEAM
21
BLOW FILTER DRAIN
24
BALLOON FILTER DRAIN
27
SHIELD FILTER DRAIN

FILL MACHINE STERILIZATION PROCESS

TECHNICAL FIELD

This invention relates to apparatus for sterilizing components through which a fluid product flows in a product filling system of a container filling machine. More particularly, the invention is especially adapted for use in automatic packaging machines in which containers of thermoplastic synthetic material are formed (e.g., by blow forming or by vacuum forming) and then filled and sealed.

BACKGROUND OF THE INVENTION

Various patents disclose methods and apparatus for blow or vacuum forming, filling, and sealing a container. See, for example, Weiler U.S. Pat. No. 3,597,793, Komendowski U.S. Pat. No. 3,919,374, Weiler et al. U.S. Pat. No. 4,176,153, Weiler et al. U.S. Pat. No. 4,178,976, Hansen U.S. Pat. Re. No. 27,155 and patents cited therein. This type of apparatus needs to be sterilized for aseptic filling of products.

Machines of the type disclosed in the aboveidentified patents may be advantageously used for packing of liquid products used in pharmaceuticals, medical devices, diagnostic processes, dentistry, nd food products. It is typically desirable, if not necessary, to form, fill, and seal containers of such fluids in a manner which keeps the container and contents free of microorganisms and other contaminants. To this end, a sterilizing agent, such as vapor having a transferable latent heat (e.g., steam) is typically utilized to sterilize the flow passages in the machine components prior to starting the production packaging operations.

Sterilization is necessary when the machine is shut down after being used with one product before switching to a second product. Even when the machine is shut down between filling operations with the same product, sterilization may be necessary or desired because contaminants can enter the machine components during shut down periods when the machine is not operating at above-atmospheric internal pressures.

A steam sterilizing system incorporated in a liquid packaging machine is disclosed in commonly owned Weiler et al. U.S. Pat. No. 4,353,398. The steam sterilization system described in that patent is designed to be connected to a source of sterilizing steam and includes two major flow paths for the sterilizing steam. One flow path directs the sterilizing system through the liquid product fill or supply lines. A second flow path directs the sterilizing steam through the process gas supply lines (e.g., lines for supplying pressurized air for blow molding the container). The two main sterilizing steam flow paths are isolatable from each other.

In the sterilizing operation disclosed in Weiler et al. U.S. Pat. No. 4,353,398, the liquid product lines are first opened to the sterilizing steam while the gas lines are isolated from the sterilizing steam. The product lines are sufficiently sterilized after the sterilizing steam has flowed through the product lines for about 30 minutes. Next, the product lines are isolated from the sterilizing steam, and the gas lines are opened to the sterilizing steam for about 15 minutes.

Although the sterilizing process disclosed in the above-discussed Weiler et al. U.S. Pat. No. 4,353,398 works well for applications for which it was designed, it has been found that it would be desirable to provide a process for effectively sterilizing the fluid product lines and gas lines within a shorter period of time and utilizing a single flow path for the sterilizing steam. This would result in a more efficient operation of the automatic packaging machine.

In an automatic packaging machine of the form-filled-seal type, the liquid product fill system and the gas supply system each typically include one or more filters and other components. Certain components, especially certain types of filters, can be damaged when subjected to an excessive pressure differential, especially at the termination of a system sterilization process when the reduced pressure produced as the sterilizing steam condenses can generate a reduced pressure differential across a portion of the system that could damage some types of filters.

Specifically, after sterilizing steam has flowed through a system for a sufficient time to effect proper sterilization, the shutting off of the steam flow permits the system to cool. The remaining steam in the system condenses during the cooling. As the steam condenses, the pressure within the system is reduced. Indeed, the system pressure may be reduced to below the ambient external pressure so as to, in effect, create a sub-atmospheric pressure within portions of the system.

The pressure reduction in the system caused by the condensing steam could result in a differential pressure across a portion of the system, including across a filter. An excessive differential pressure across the filter is likely to damage the system filters. Inasmuch as the capability of some types of filters to withstand a differential pressure decreases with increasing temperature, such filters are particularly vulnerable to damage in the immediate post-sterilization (i.e., cool-down) time period.

Further, the sub-atmospheric pressure in the system could result in the ingress of bacteria or other contaminants carried by the relatively higher pressure ambient atmosphere that may leak into the system.

In view of the potential contamination problem and in view of the potential damage problem with respect to filters and other components as the sterilization process is terminated, it would be desirable to provide an improved sterilization process that would maintain the systems at pressures greater than atmospheric and that would minimize pressure differentials.

It would also be advantageous if such an improved system could be provided with the capability for automatically accommodating the operation of the sterilization process throughout a range of pressures and for responding to a wide range of potential differential pressures. To this end, it would also be beneficial if such an improved process could be adapted for control in response to one or more process parameters, such as cycle time or system pressure. This would provide the user with a desirable selectivity of operational alternatives.

The sterilization process using steam to heat the components of the filling machine must be effected for a time period sufficient to effectively sterilize the component surfaces. The above-discussed U.S. Pat. No. 4,353,398 discloses a conventional sterilizing method wherein the sterilizing steam is controlled to flow through the system for a predetermined time interval. Although this works well in systems for which the steam sterilizing process is particularly designed, test runs must be made to provide temperature measurement data for use in designing the process to ensure that the system is subjected to a heat up period of sufficient duration to raise the temperature of the components to a proper sterilizing temperature at the beginning of the sterilizing interval.

The length of time that it takes components in a system to reach a predetermined elevated sterilizing temperature depends on, among other things, the component material and mass. Thus, once such a particular sterilization process has been conventionally designed for a particular system, it cannot be readily used with other systems or even with the same system for which it was designed if components of that system are changed. Accordingly, it would be desirable to provide an improved sterilization system that could effectively sense and register the temperature of one or more of the system components. Further, it would be advantageous if such an improved sterilization system could be provided with a control system for automatically controlling the introduction of steam to the components to be sterilized and for maintaining the flow of steam for a predetermined time interval after at least one selected component has reached a predetermined, elevated, sterilizing temperature.

SUMMARY OF THE INVENTION

The present invention provides a method for efficiently steam sterilizing plural components through which a liquid product flows in a container filling machine (i.e., in the product filling system in the machine).

In one preferred form of the method, the components (equipment and piping) in an associated process gas supply system in the machine are sterilized concurrently with the components in the liquid product fill system.

In another preferred form of the invention, the sterilizing process is controlled in response to the sensing of the temperature in one or more of the components throughout the sterilization process and cool-down of the components.

A novel process is also employed in one form of the invention to protect components during cool-down from being subjected to sub-atmospheric internal pressures and potentially damaging pressure differentials.

A preferred form of the method of the present invention incorporates all of the above-described process features for use in one filling machine having both a product filling system and a process gas supply system. Specifically, steam is directed from a common source into the product filling system and into the process gas supply system substantially concurrently in a single pass. The steam is maintained in the system for a period of time sufficient to sterilize the system components.

As the sterilized components cool, the components are pressurized with a gas to prevent the resulting internal pressure in the system from decreasing below ambient atmospheric pressure. Where sterilizing filters are employed at the inlet end of a system, non-sterile gas can be used to pressurize the system if the gas is introduced upstream of the filters.

The pressure of the gas may be maintained at a pressure substantially above the ambient atmospheric pressure or at a pressure just slightly greater than the ambient atmospheric pressure—depending upon the initial steam pressure and capabilities of the system components to stand pressure differentials. In a preferred form of a machine having both a product filling system and a process gas supply system, the pressurizing gas may be introduced from a common source into both the process gas supply system and the liquid product filling system to prevent the internal pressure in both systems from decreasing below the ambient atmospheric pressure as the sterilizing steam condenses.

In a preferred form of the sterilizing process, the temperature of a system temperature-characterizing component, preferably the component having the largest mass, is sensed as it is subjected to the sterilizing steam. The flow of sterilizing steam through the system is terminated only after (1) a predetermined elevated temperature has been sensed in the selected component, and (2) the component has been maintained at that temperature for the time period needed to effect the desired degree of sterilization. The system is then permitted to cool to ambient temperature. This temperature-based control process may be employed with or without the use of a pressurizing gas during system cool-down. Further, the process may be used with a preferred form of the container filling machine having components that define a separate process gas supply system and a separate fluid product filling system.

It will be appreciated that the sterilizing method of the present invention is readily employed with automatic machines for forming, filling, and sealing thermoplastic containers wherein such machines have fluid product filling systems and process gas supply systems. Both the fluid product filling systems and the process gas supply systems can be efficiently sterilized concurrently. Further, the sterilization process can be readily automatically controlled. The sterilization temperature and holding time at that temperature can be automatically maintained and controlled.

Where the machine systems include components, such as filters, that could be damaged by pressure differentials, the novel method of the present invention provides a means for eliminating or reducing potentially damaging pressure differentials that can arise when the sterilizing steam condenses upon termination of the sterilization process.

Further, since the method of the invention can prevent the pressure in the system from dropping below the ambient atmospheric pressure after the sterilization process is terminated, the method effectively prevents the entrainment or leakage of bacteria or other contaminants into the system.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 3 is a plan of how a large schematic diagram has been divided into four smaller diagrams designated FIG. 3*a*, 3*b*, 3*c*, and 3*d* wherein the FIGS. 3*a*, 3*b*, 3*c*, and 3*d* together illustrate of a specific embodiment of the method illustrated in FIG. 2 as employed with an automatic packaging machine for forming, filling, and sealing a container.

FIG. 7 is a plan of how a large table has been divided into two halves designated FIG. 7*a* and 7*b* wherein the table lists the sequence of the sterilization cycle modes or stages and corresponding valve positions for the components illustrated in FIGS. 3*a*–3*d*, 4*a*–4*d*, 5*a*–5*d*, and 6*a*–6*d*.

DESCRIPTION OF THE PREFERRED EMBODIMENTS

While this invention is susceptible of embodiment in many different forms, this specification and the accompanying drawings disclose only some specific forms as examples of the use of the invention. The invention is not intended to be limited to the embodiments so described, and the scope of the invention will be pointed out in the appended claims.

The method of this invention is used with conventional components and machines the details of which, although not fully illustrated or described, will be apparent to those having skill in the art and an understanding of the necessary functions of such components and machines.

Some of the Figures illustrate preferred forms of the invention method and show representations of structural details, components, and machines that will be recognized by one skilled in the art. However, the detailed description of such elements are not necessary to an understanding of the invention, and accordingly, are not herein presented.

According to one aspect of the invention method, flow passages in components of the liquid product filling system and the process gas supply system of a filling machine can be sterilized concurrently in a single pass in an effective and efficient manner. In a preferred form of the invention, the sterilizing process of one or more systems is controlled in response to the sensing of the temperature in one or more of the components throughout the sterilization process and cool-down of the components.

Further, in another preferred form, the components are protected during cool-down from being subjected to sub-atmospheric internal pressures and potentially damaging pressure differentials.

Figure 1:
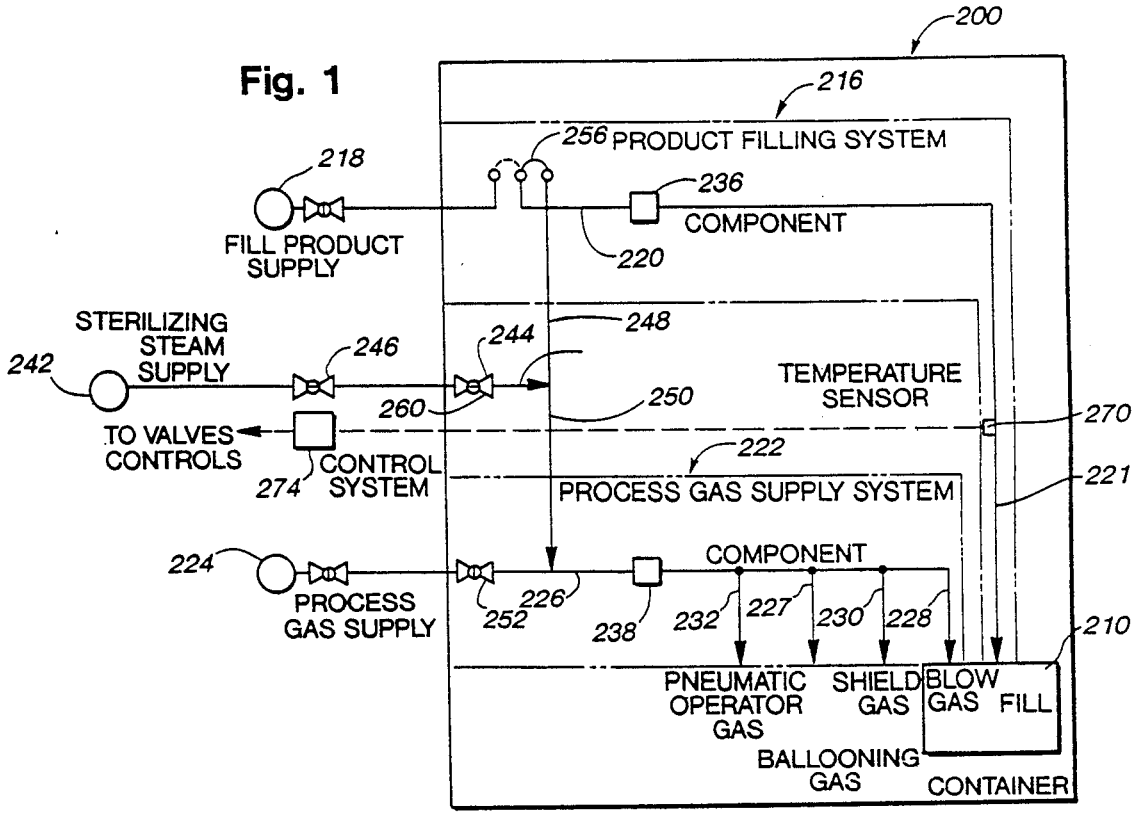
FIG. 1 is a schematic diagram illustrating one form of the method of the present invention.

Referring now to the drawings, FIG. 1 is a schematic diagram of one form of the invention method as employed with a liquid packaging machine 200. A conventional automatic liquid packaging machine includes systems for blow molding a container 210, for filling the container 210 with a liquid product, and for subsequently sealing the container 210. It will be appreciated, however, that the form of the method illustrated in FIG. 1 may also be employed with any suitable packaging machine 200 that includes both a fluid product filling system and a process gas supply system but that does not mold the container and seal the container.

A conventional automatic packaging machine 200 typically has a product supply system 216 which can include, or be connected to, a source 218 of the fluid product. The fluid product is carried through an appropriate filling line or conduit 220 to a fill nozzle 221 for discharge into the container 210.

In a typical automatic packaging machine, the container 210 is first molded from thermoplastic material which is extruded as a hollow tube or parison (not illustrated) from an extruder (not illustrated). A split mold assembly (not illustrated) is positioned with two lower mold halves around the parison. Holding jaws (not illustrated) are moved to grip the parison. To prevent the parison from collapsing on itself, a process gas supply system 222 supplies pressurized gas, such as air or nitrogen, from a source 224 (typically a connection to an external air or nitrogen supply) for being directed through a gas supply line 226 (having suitable sterilizing filters) to an extruder gas conduit 227 for discharge into the parison. This gas is typically referred to as the "ballooning" gas.

The parison is cut from the extruder by a pneumatically operated cutter or knife (not illustrated). In a preferred form of the machine, the mold assembly is then positioned below a blow nozzle 228 which is supplied from gas line 226 and which is coaxial with a liquid product fill nozzle 221 in a combination blowing and filling assembly. The blowing and filling assembly is lowered into the lower mold halves in sealing engagement with the parison. Pressurized gas, such as nitrogen or air, is discharged through the blow nozzle 228 to expand and press the parison into the walls of the mold in the shape of the container 210. While the blowing and filing assembly is still in place, the product fill nozzle 221 is actuated to dispense the fluid product into the container 210.

It is also contemplated that the blowing and filling machine could have a different design wherein the blow nozzle 228 and fill nozzle 221 are not coaxially aligned in a common assembly. For example, a separate blow nozzle 228 could be first engaged with the parison to blow mold the container and subsequently fully retracted from the container 210. Next, relative movement would be effected between the product fill nozzle 221 and the container 210 (which is carried in the mold assembly) so as to effect the positioning of the fill nozzle 221 in the container 210. The fluid product would then be dispensed through the nozzle 221 into the container 210.

Also, the sterilizing method of the present invention may be used to sterilize a fluid product filling system and process gas system in a filling machine that receives a previously formed container and that fills the container with fluid product through the fill nozzle 221.

In any event, when the fluid product is discharged through the fill nozzle 221 into the container 210, air is typically vented from the container through appropriate passageways (not illustrated in FIG. 1). Also, during the blow molding and/or filling of the container 210, parts of the mold assembly, blow nozzles and fill nozzles may be surrounded by an enclosure (not illustrated in FIG. 1) which is pressurized with sterile air, as from a discharge conduit or passage 230. This forms a pressurized shield of sterile air around the working area to prevent ingress of bacteria and other contaminants.

Additionally, the process gas may be directed through a suitable conduit 232 into internal assemblies in the machine that operate to discharge a metered amount of the fluid product from the product supply 218 through the fill nozzle 221 into the container 210. The process gas may also be used to operate other components in the machine, such as a pneumatic actuator for the parison cut-off knife.

The product filing system 216 and the process gas supply system 222 typically include additional components 236 and 238, respectively, such as piping, conduit, flow control and monitoring components, drain assemblies, filter assemblies, and sampling assemblies. Such components are described in the above-discussed Weiler et al. U.S. Pat. No. 4,353,398, and the descriptions of those components set forth in that patent are incorporated herein by reference thereto to the extent not inconsistent herewith.

According to one aspect of the present invention, a method is provided for sterilizing the components of the product filling system 216 and process gas supply system 222 in a very efficient and effective manner. More particularly, the fluid-contacting surfaces of the flow passages defined in the components are sterilized in the improved manner. Specifically, with reference to FIG. 1, a source 242 of sterilizing steam is connected to the liquid packaging machine 200 through a supply line 244. Exterior to the machine 200, the sterilizing steam supply 242 is provided with at least one isolation valve 246 that is normally closed when the sterilizing process is not in operation.

The steam supply line 244 is directed to the product filling system line 220 via a line 248 and to the process gas supply system line 226 via a line 250. A valve 252 is provided in the line 226 to isolate the process gas supply system 222 from the exterior process gas supply 224.

To ensure isolation of the product filling system from the exterior fill product supply during sterilization, a swing elbow 256 is employed to connect the sterilizing steam line 248 with the product filling system line 220 during sterilization. During normal operation when the fill product is supplied to the liquid packaging machine 200, the swing elbow 256 is disconnected from the steam supply line 248 and is assembled in the product filing system line 220 to connect the product filling system 216 with the fill product supply 218. Other suitable means may be employed instead of a swing elbow 256, such as a blind flange, isolation valve, etc.

The liquid packaging machine 200 is preferably provided with an inlet shut off valve 260 on the sterilizing steam supply line 244. When the liquid packaging machine 200 is to be sterilized according to the method of the present invention, the valve 260 is opened after closing the process gas supply inlet isolation valve 252 and after connecting the swing elbow 256 between the steam supply line 248 and the product filling system line 220 to isolate the fill product supply. Thus, with the novel process of the present invention, sterilizing steam can be directed to both the product filling system 216 and the process gas supply system 222 substantially concurrently or simultaneously. This is more efficient than conventional processes in which the product filling system is sterilized before, and separately from, the process gas supply system.

It will be appreciated that not all lines or components in the product filling system 216 and process gas supply system 222 need be subjected to sterilizing steam. Typically, both the product filling system 216 and the process gas supply system 222 would each include at least one sterilizing filter (as one of the components 236 and 238) for trapping certain bacteria or other contaminants. Thus, in many situations, only the piping and components downstream of such filters need to be sterilized. However, with some system designs, it is possible to reduce the complexity of the sterilizing steam supply system piping, connections, and controls by introducing the sterilizing steam into the product filling system and process gas supply system upstream of such filters.

In any event, the components in portions of the system for which sterilization is desired should be subjected to the steam flow for a period of time sufficient to heat the components to the desired sterilizing temperature. Additionally, the steam flow is preferably maintained through the systems for a sufficient time period or interval at the sterilization temperature to ensure the proper degree of sterilization. To this end, another aspect of the present invention contemplates sensing the temperature in at least a selected portion of one of the components. Preferably, a component is selected that is characteristic of those portions of the system having the lowest temperature or requiring the greatest heat input, such as the component with the greatest mass in contact with the steam.

FIG. 1 illustrates a suitable conventional temperature sensor 270, such as a conventional thermocouple, mounted adjacent the fill nozzle 221 within the structure of the fill nozzle assembly (which structure per se is not illustrated). Typically, the fill nozzle assembly is the most massive of the components in contact with the fluid product. Thus, when the fill nozzle assembly has reached the sterilizing temperature, the other, less massive components, should also have reached the sterilizing temperature.

The signal from the temperature sensor 270 is monitored by a suitable control system 274 which can provide an appropriate indication that the sterilizing temperature has been reached and which can preferably also maintain the steam sterilizing flow for a predetermined sterilizing period to provide the desired degree of sterilization. Thereafter the control system 274 can operate to terminate the sterilizing steam flow by closing appropriate valves (e.g., valve 260).

Other temperature sensors (not illustrated in FIGS. 1 and 2) may be provided for sensing the temperature in other portions of the system or systems and for providing other indicating or control functions. For example, during the initial introduction of sterilizing steam into the product filling system 216 and process gas supply system 222, condensation will occur. Thus, condensate must be removed from the system. To this end, suitable drain systems (not illustrated in FIGS. 1 and 2) can be automatically opened upon initiation of the sterilizing process and can then be closed after the additional temperature sensors located in appropriate parts of the drain system indicate the presence of the higher temperature steam following the elimination of the lower temperature condensate.

Figure 2:
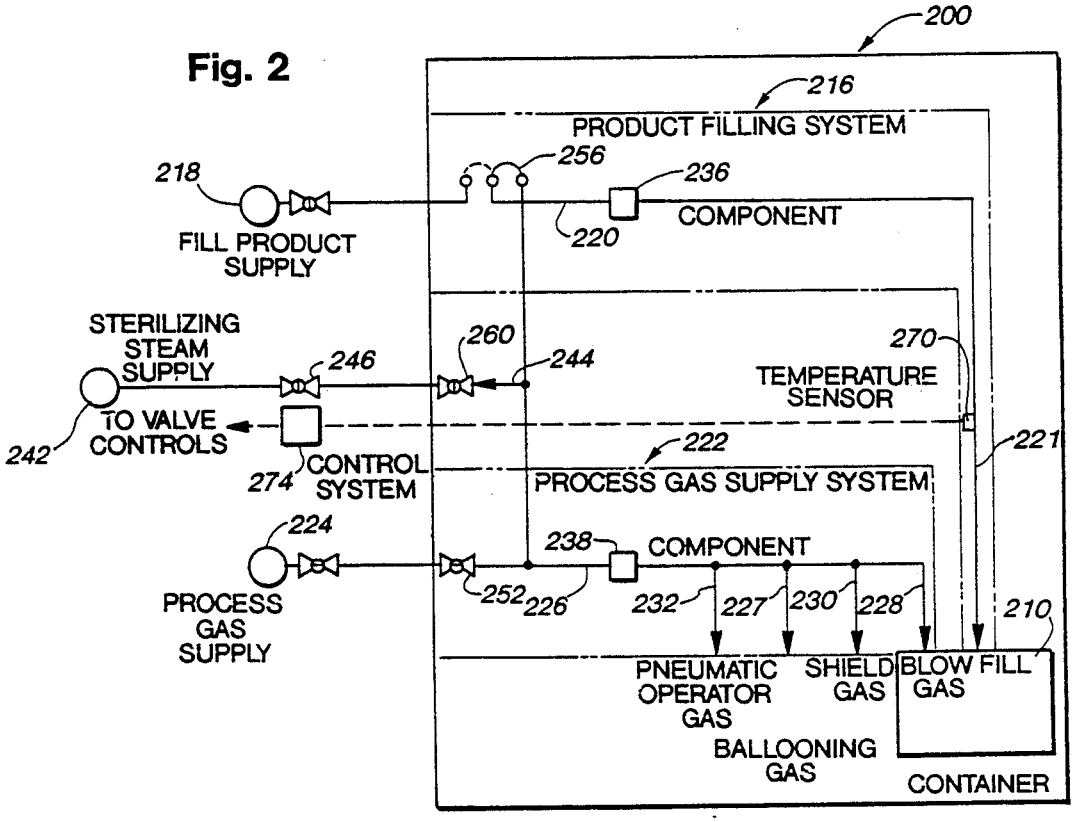
FIG. 2 is a schematic diagram illustrating another form of the method of the present invention.
Figure 3A:
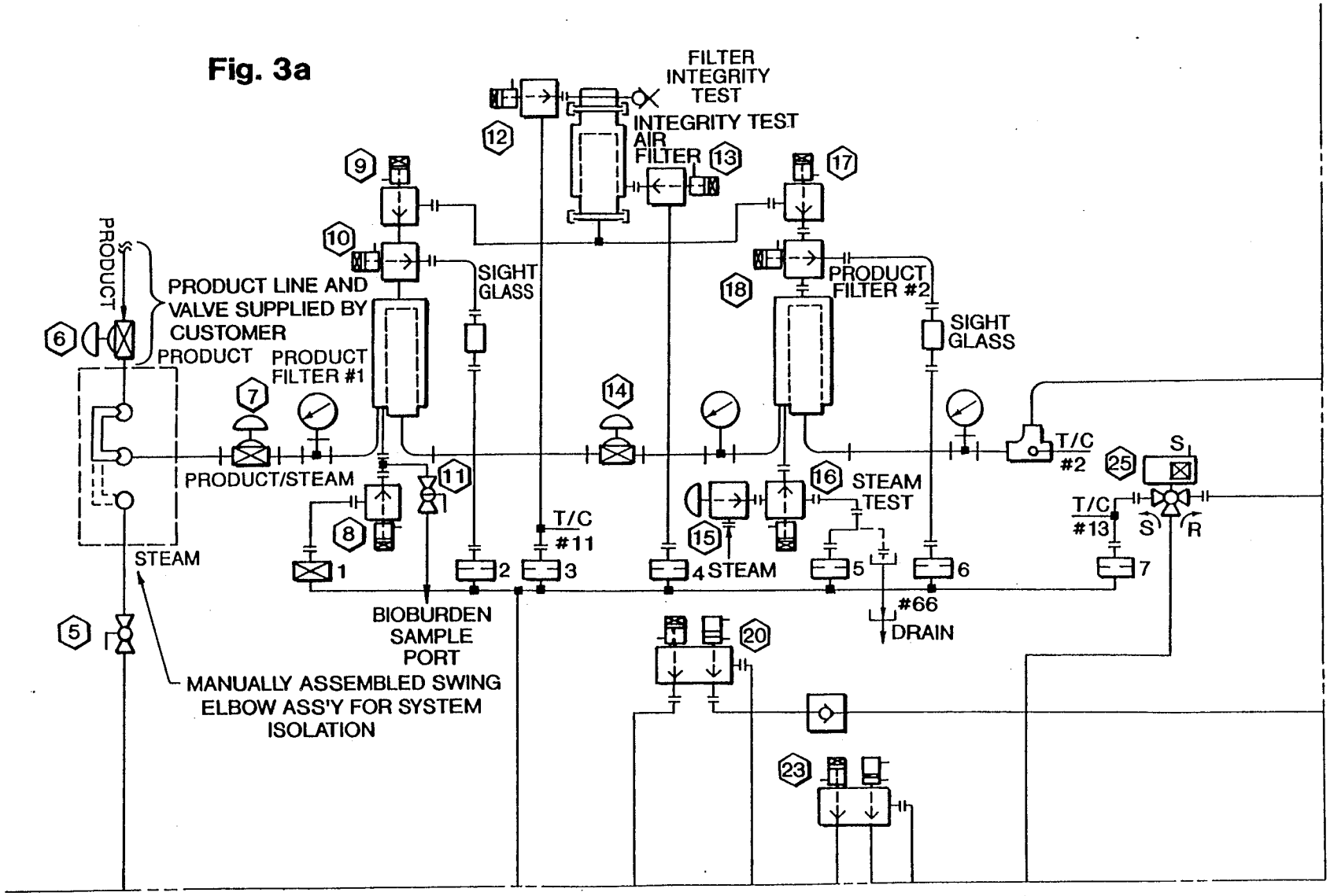
FIGS. 3*a*, 3*b*, 3*c*, and 3*d* show the machine components in their normal operating position prior to or after sterilization.
Figure 3B:
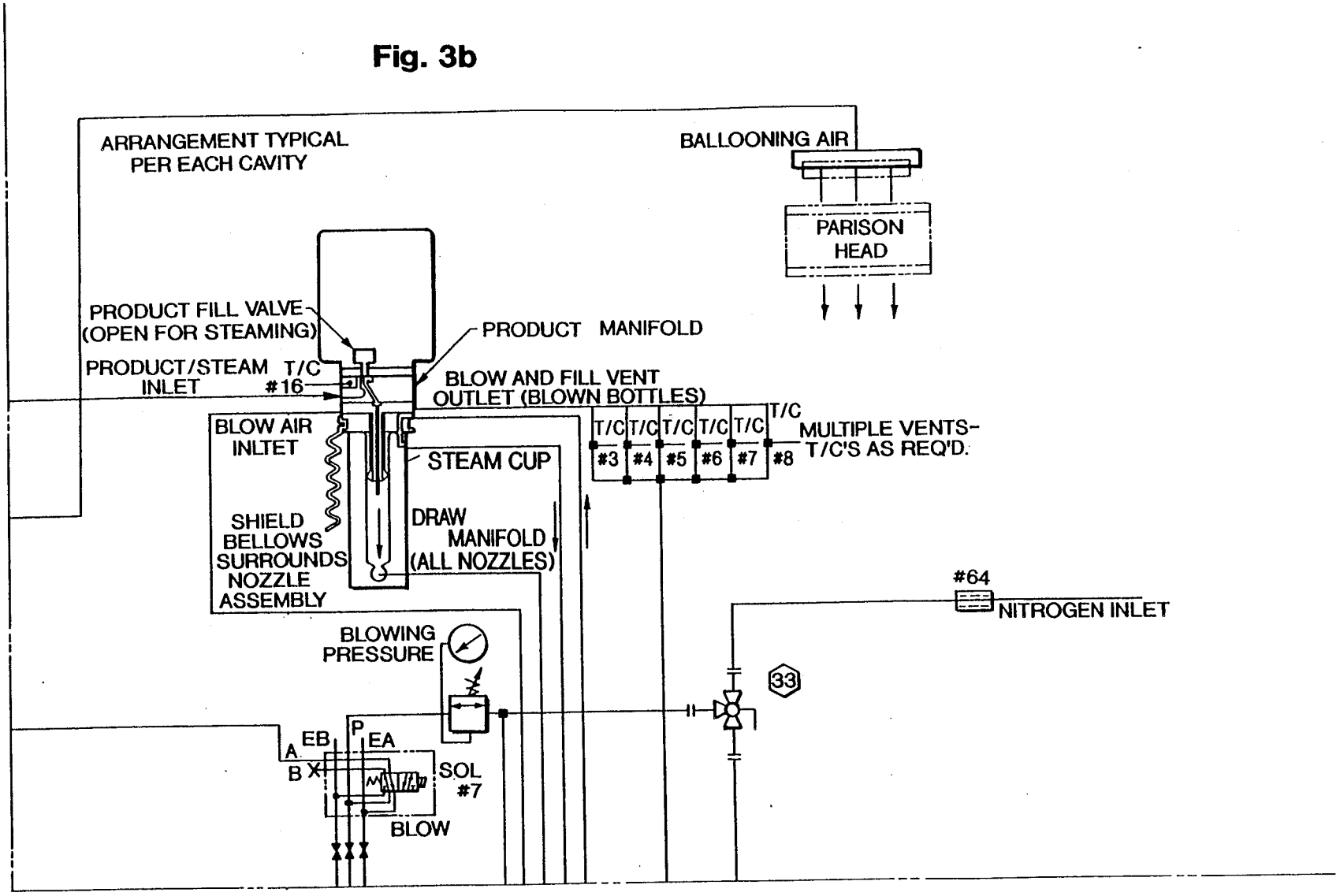
Figure 3C:
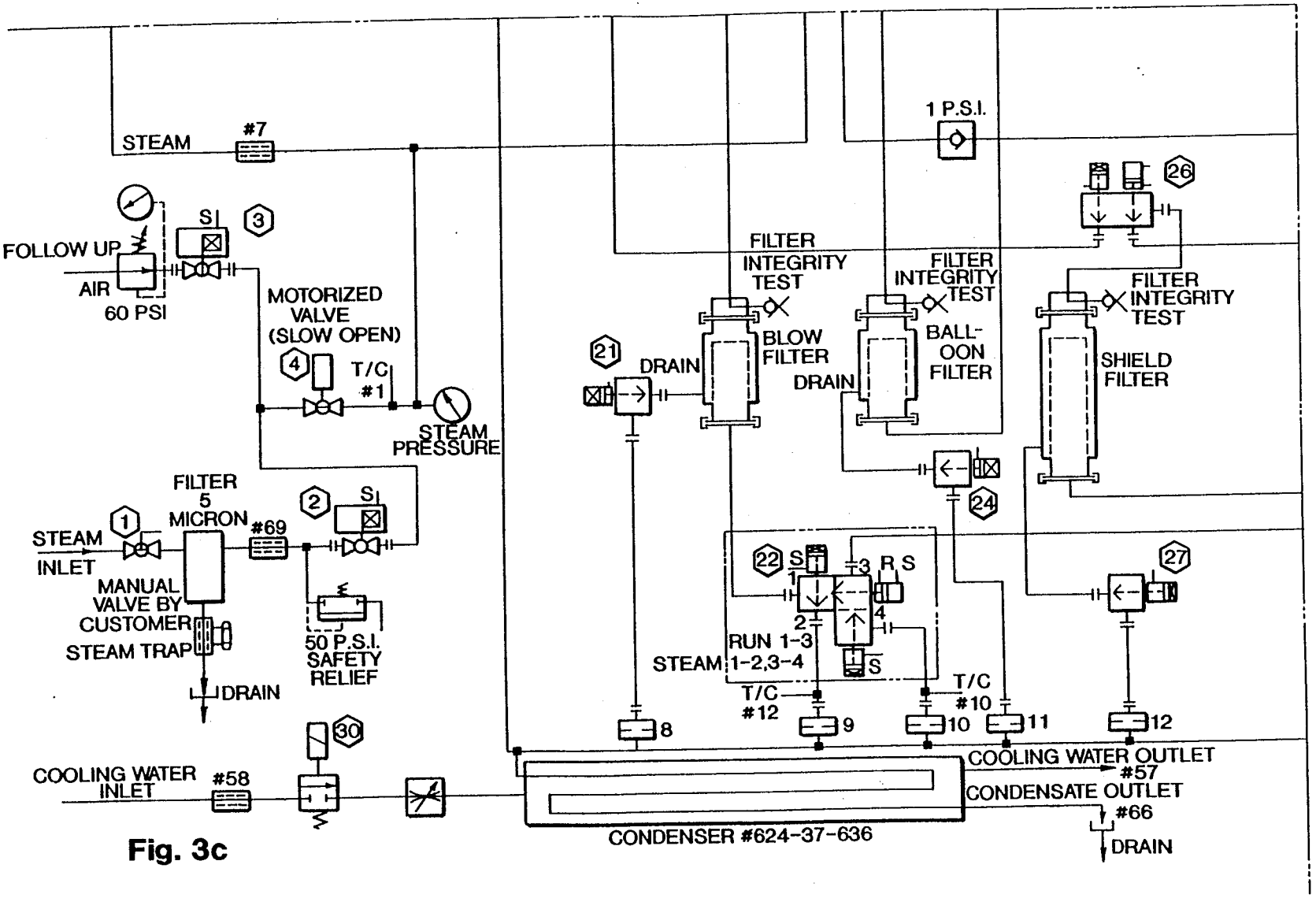
Figure 3D:
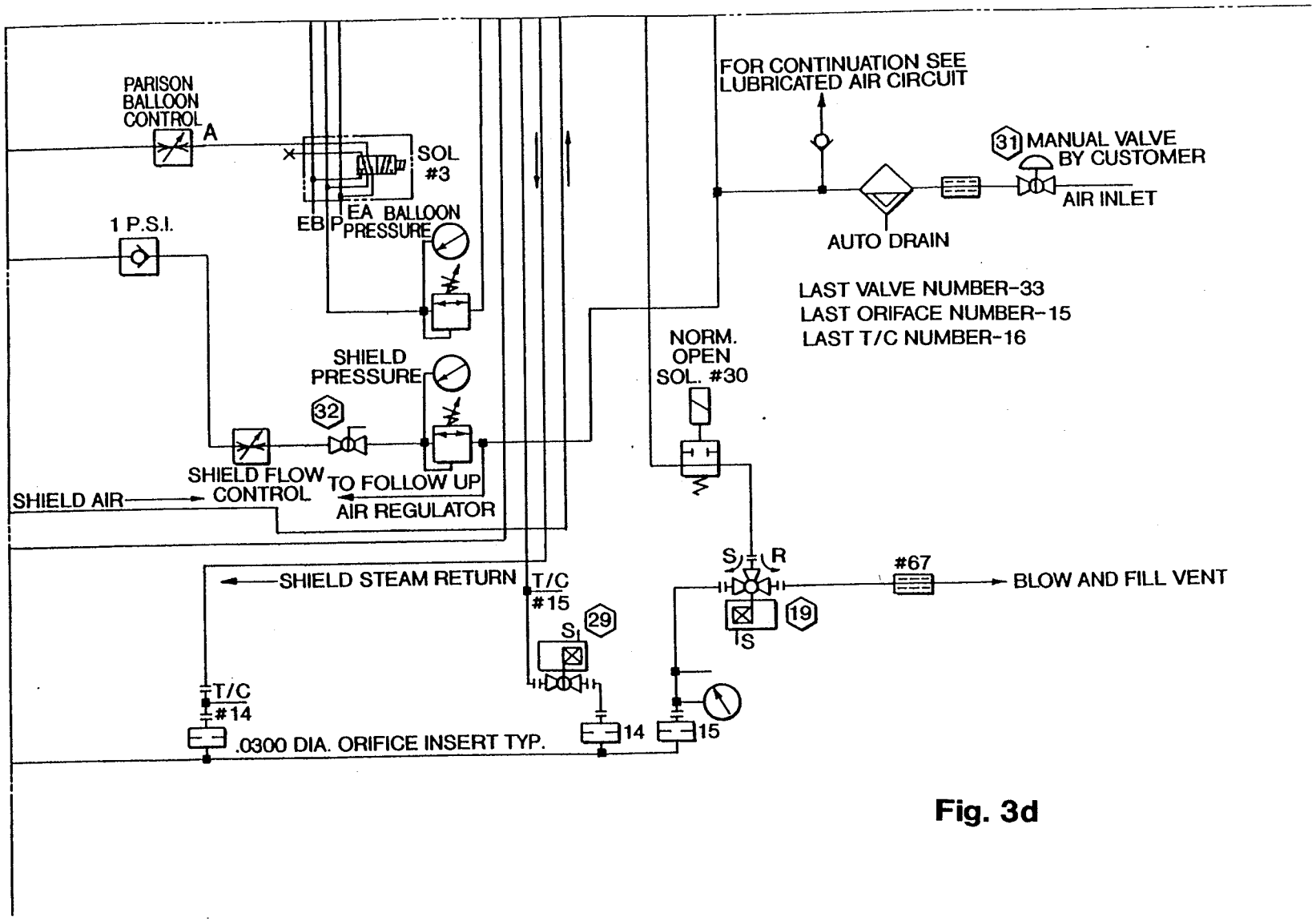
Figure 4A:
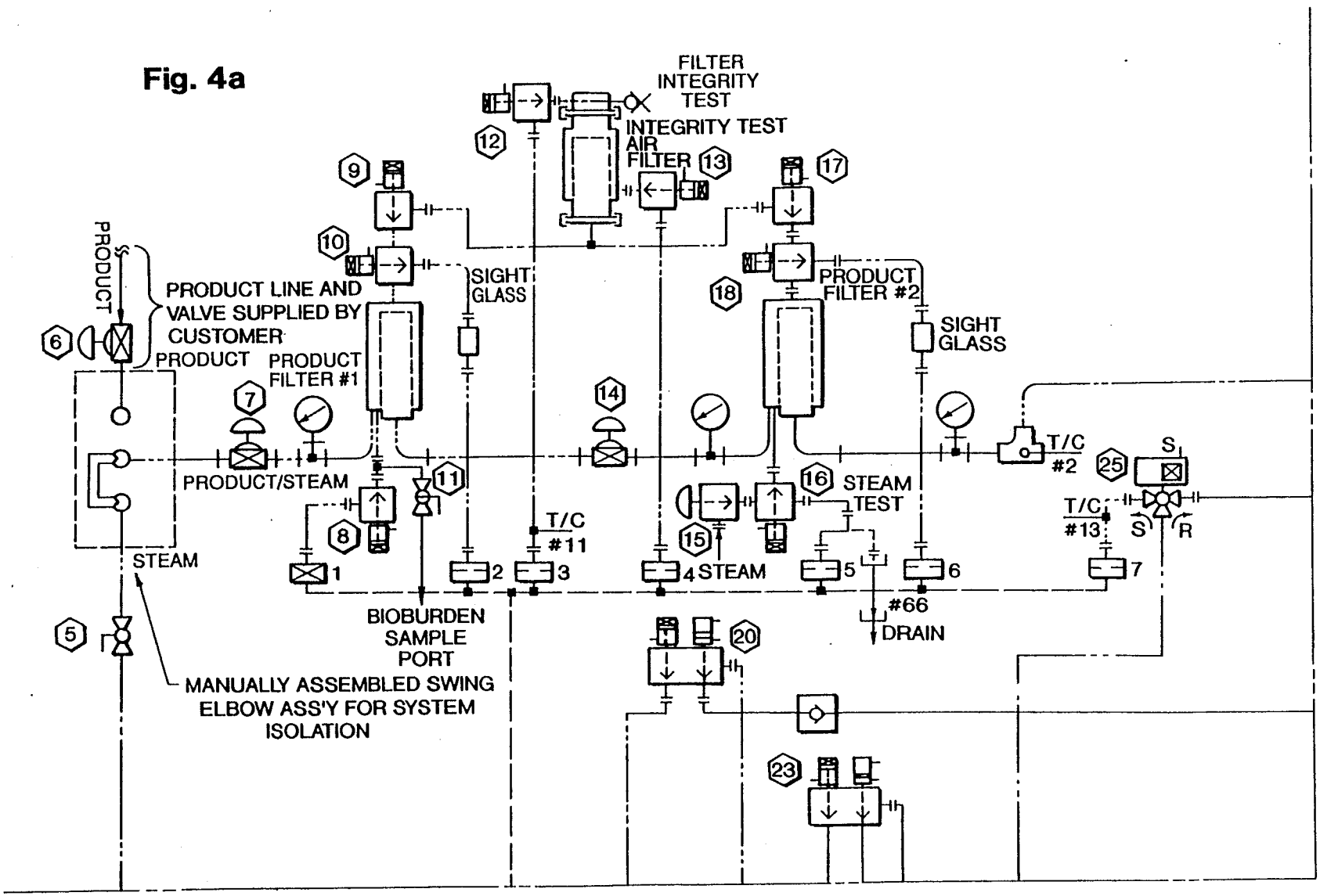
FIG. 4 is a plan similar to FIG. 3 of how a large schematic diagram has been divided into four smaller diagrams designated FIG. 4*a*, 4*b*, 4*c*, and 4*d* wherein the FIGS. 4*a*, 4*b*, 4*c*, and 4*d* together illustrate the components in their positions for accommodating the initial flow of sterilizing steam.
Figure 4B:
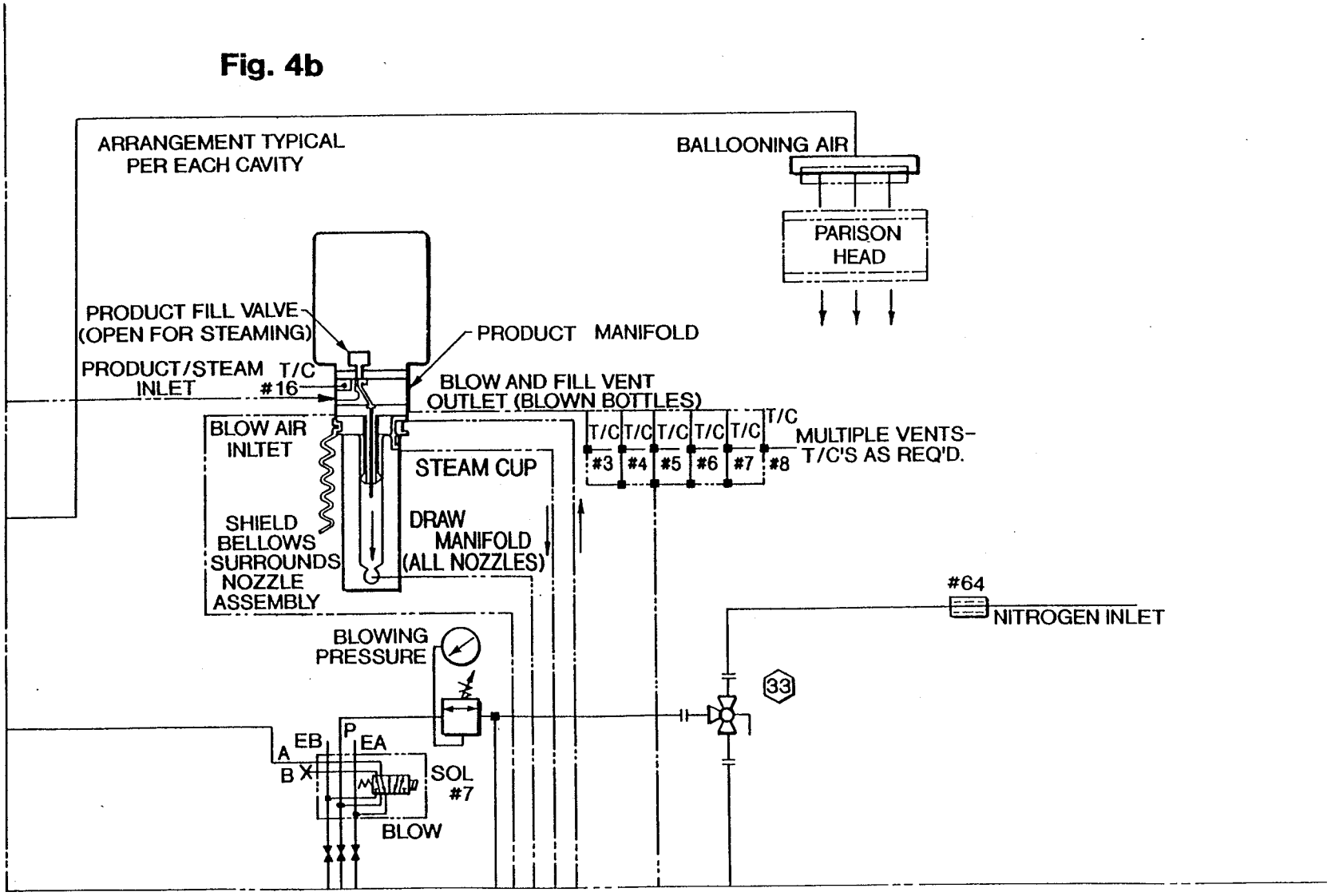
Figure 4C:
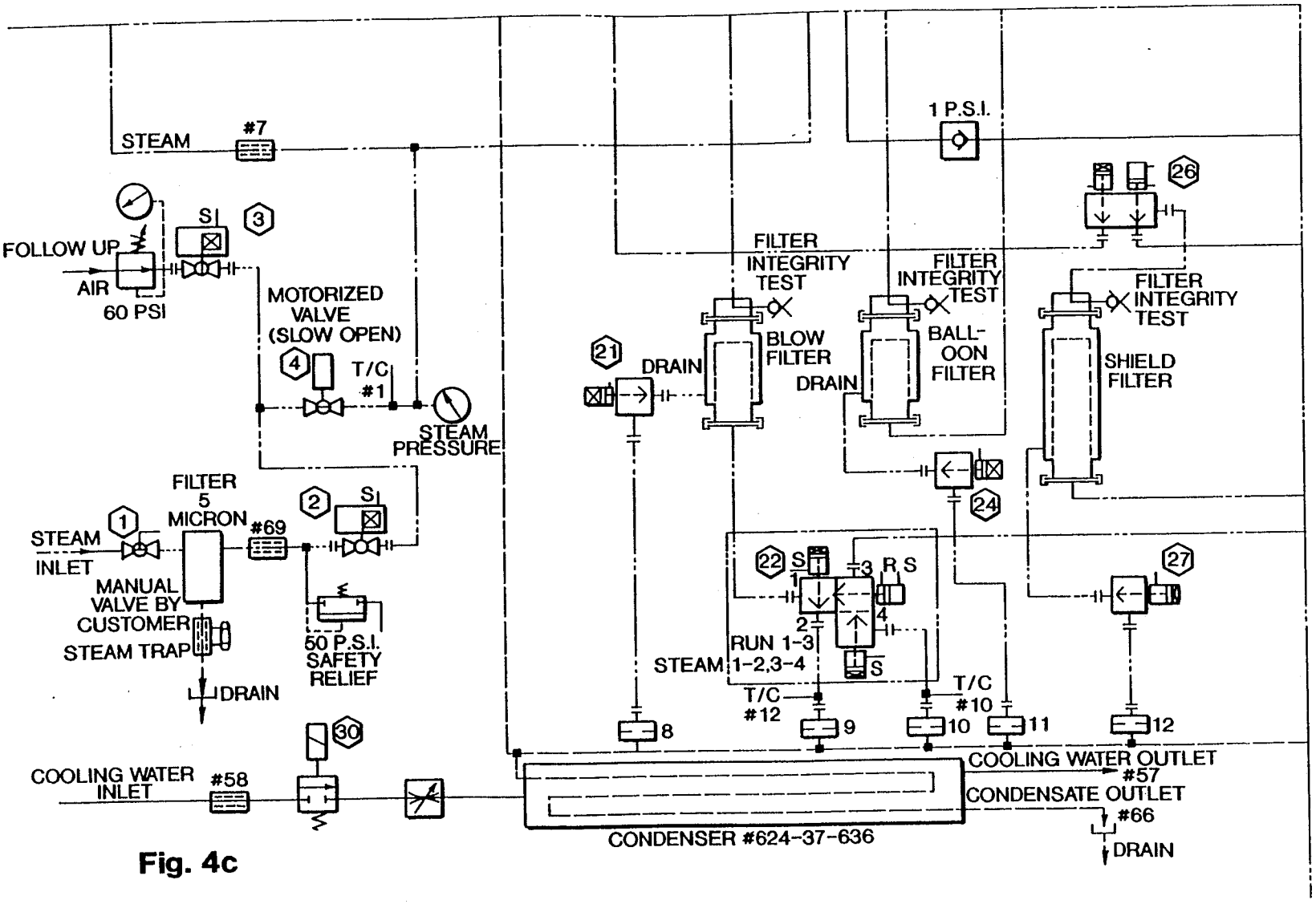
Figure 4D:
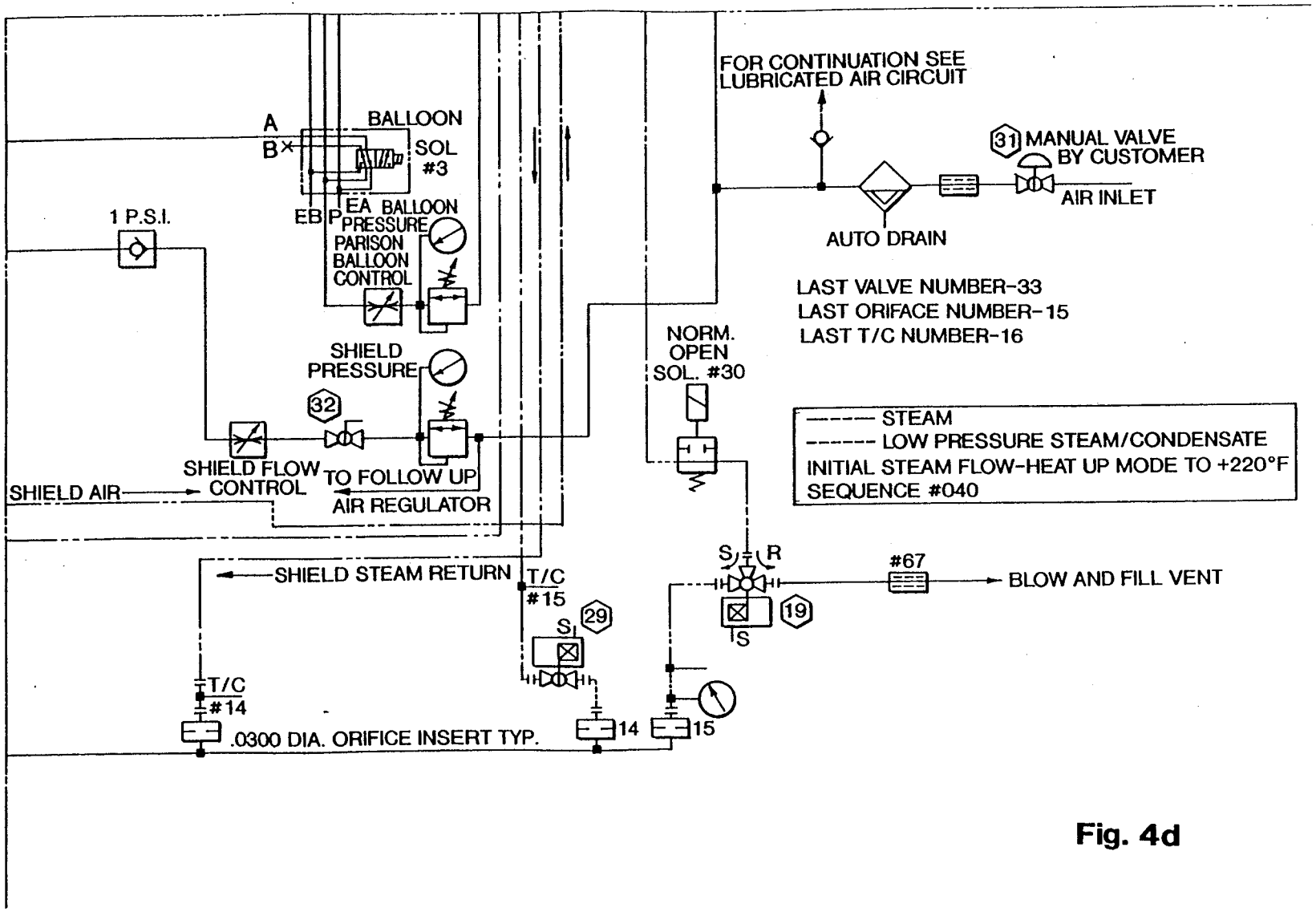
Figure 5A:
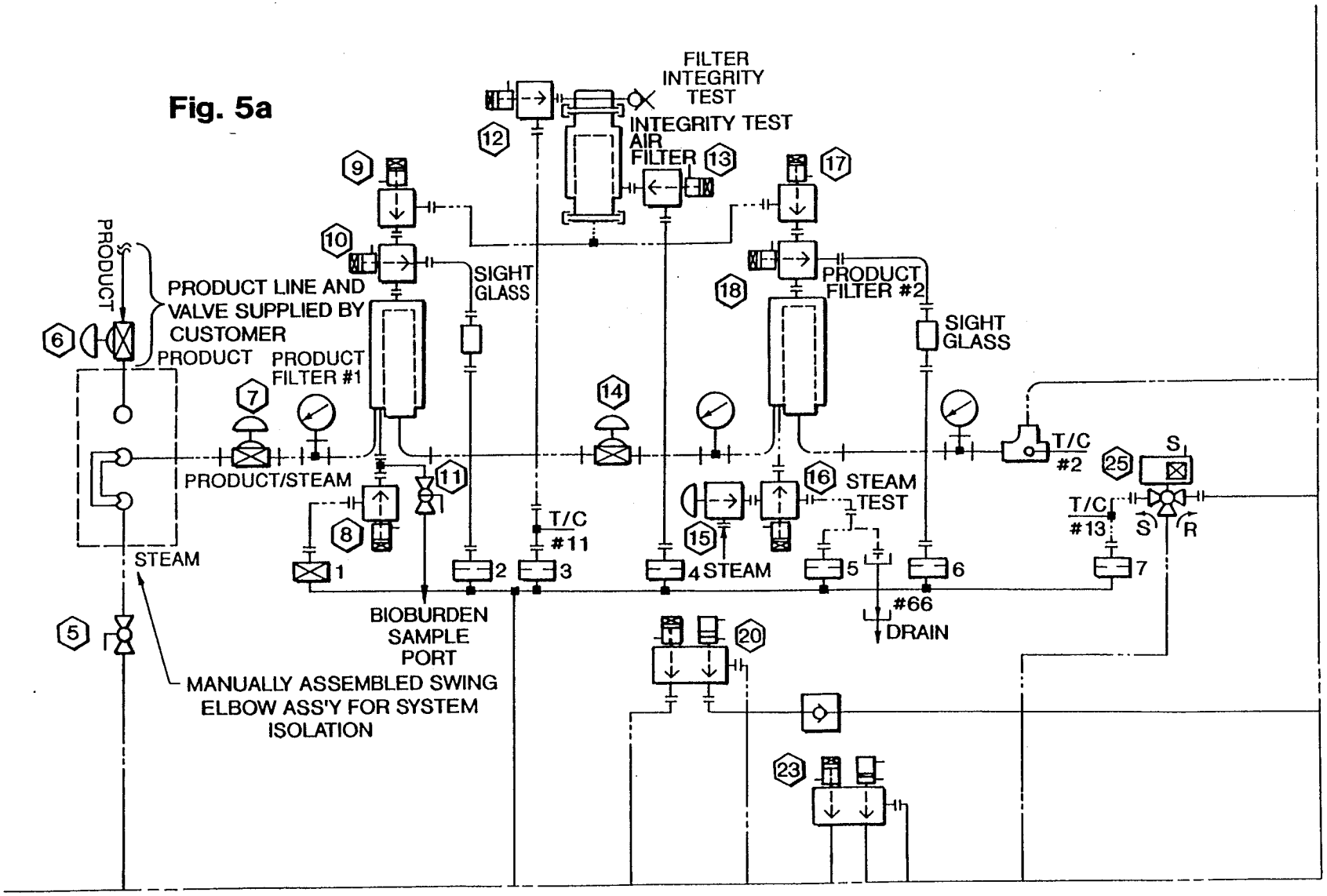
FIG. 5 is a plan similar to FIG. 3 of how a large schematic diagram has been divided into four smaller diagrams designated FIG. 5*a*, 5*b*, 5*c*, and 5*d* wherein the FIGS. 5*a*, 5*b*, 5*c*, and 5*d* together illustrate the components in their positions for accommodating the sterilizing steam flow after the initial steam condensate has been removed.
Figure 5B:
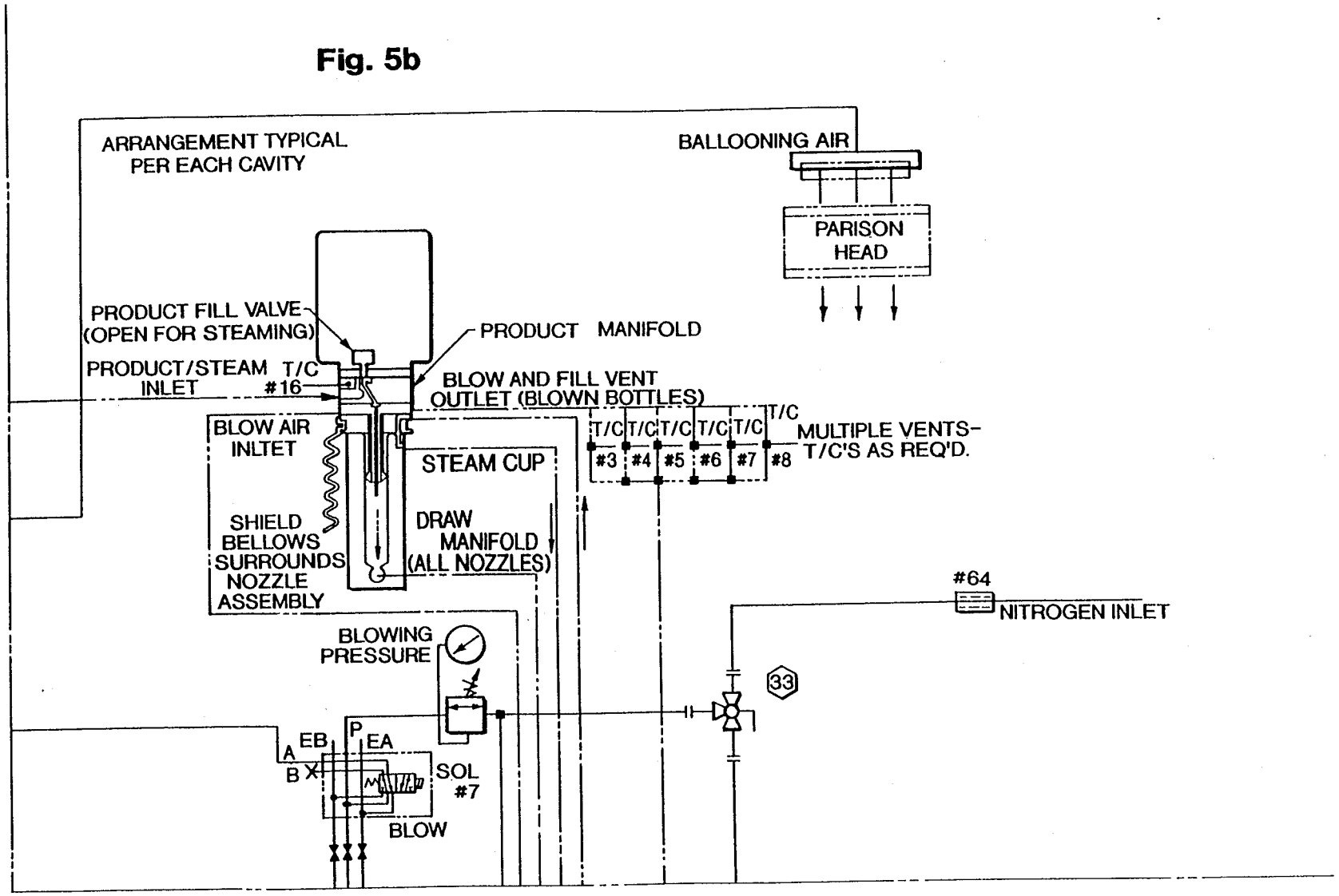
Figure 5C:
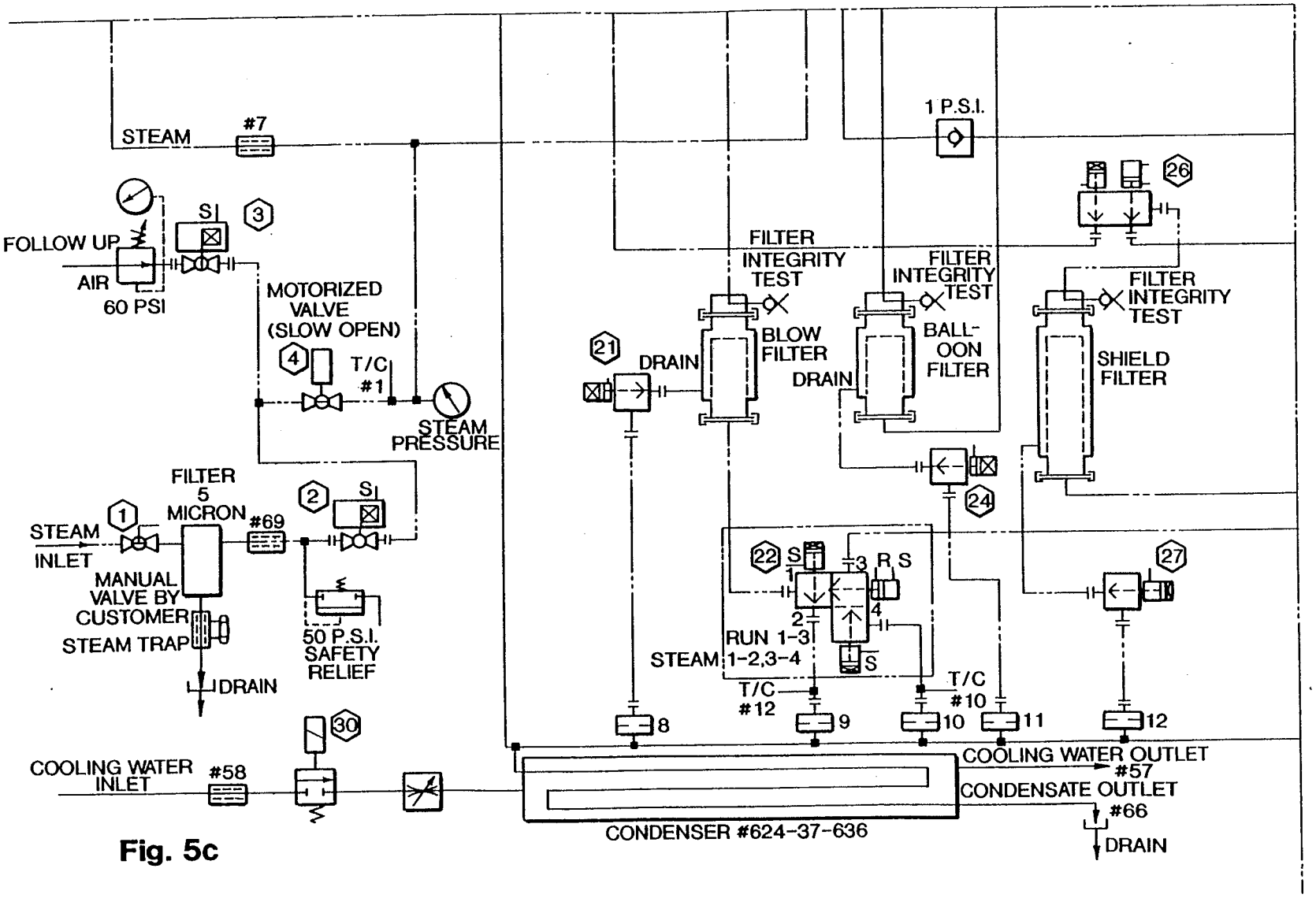
Figure 5D:
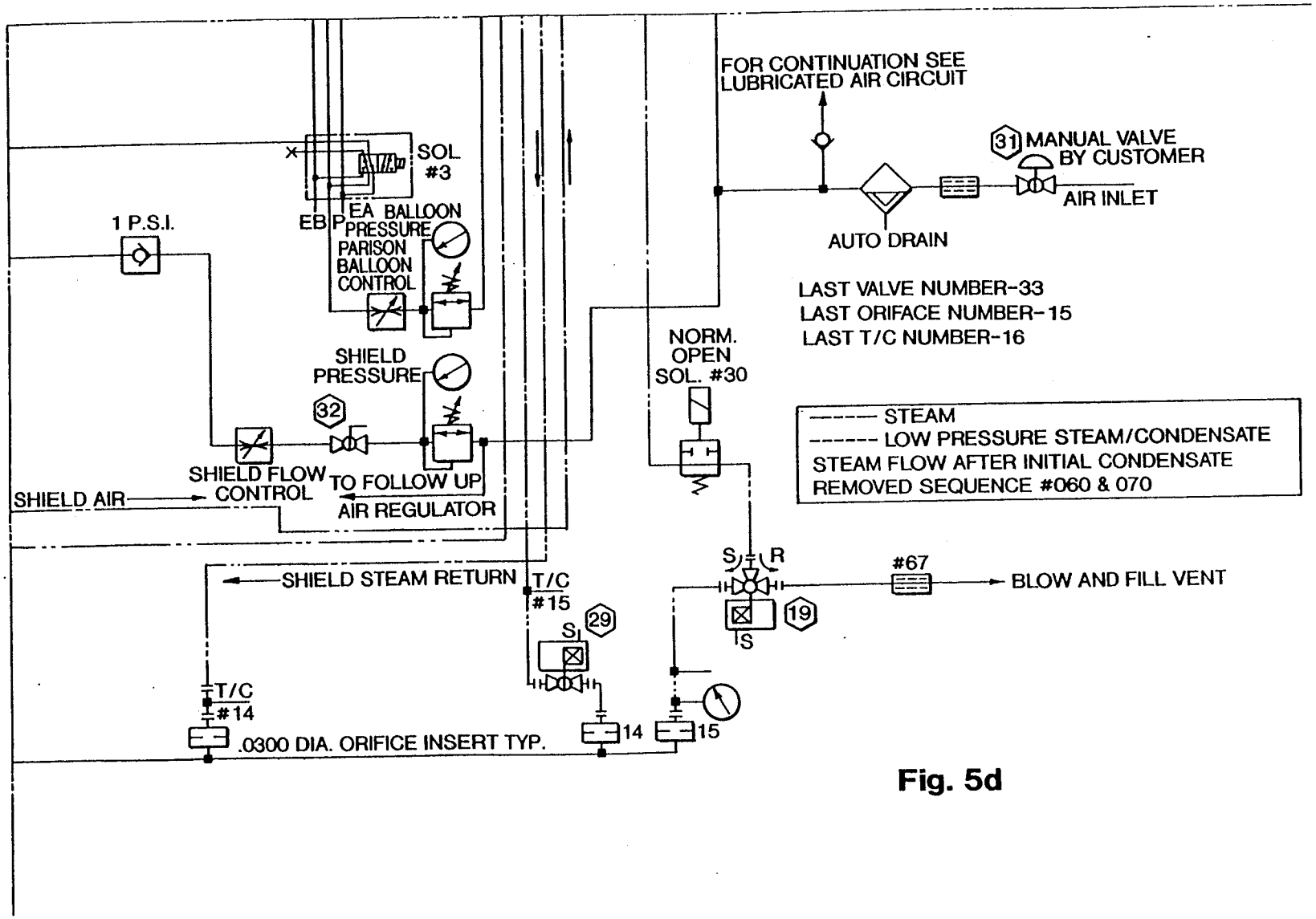
Figure 6A:
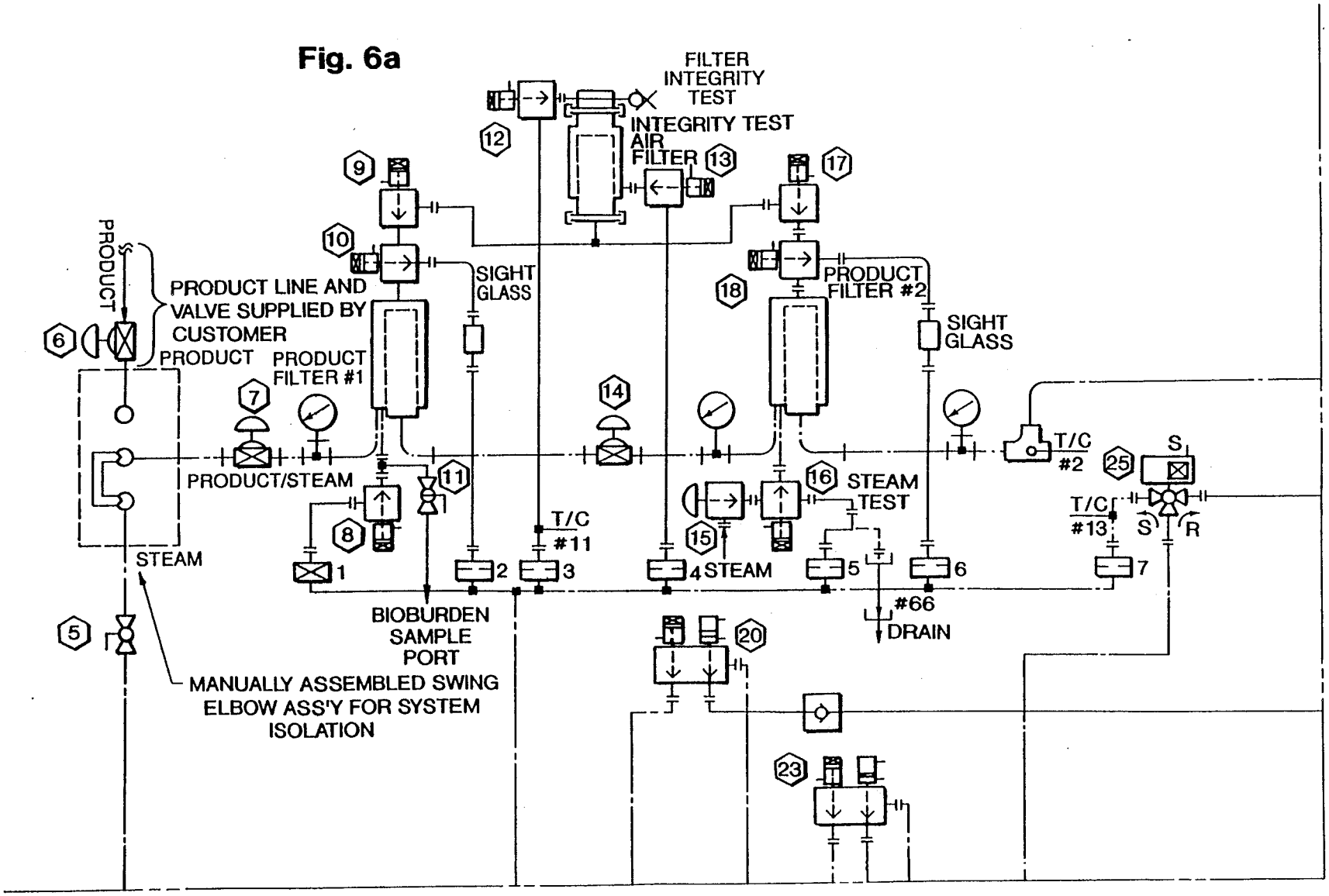
FIG. 6 is a plan similar to FIG. 3 of how a large schematic diagram has been divided into four smaller diagrams designated FIG. 6*a*, 6*b*, 6*c*, and 6*d* wherein the FIGS. 6*a*, 6*b*, 6*c*, and 6*d* together illustrate the components in their positions after the sterilizing steam flow has been terminated to accommodate air pressurization with "follow up" air.
Figure 6B:
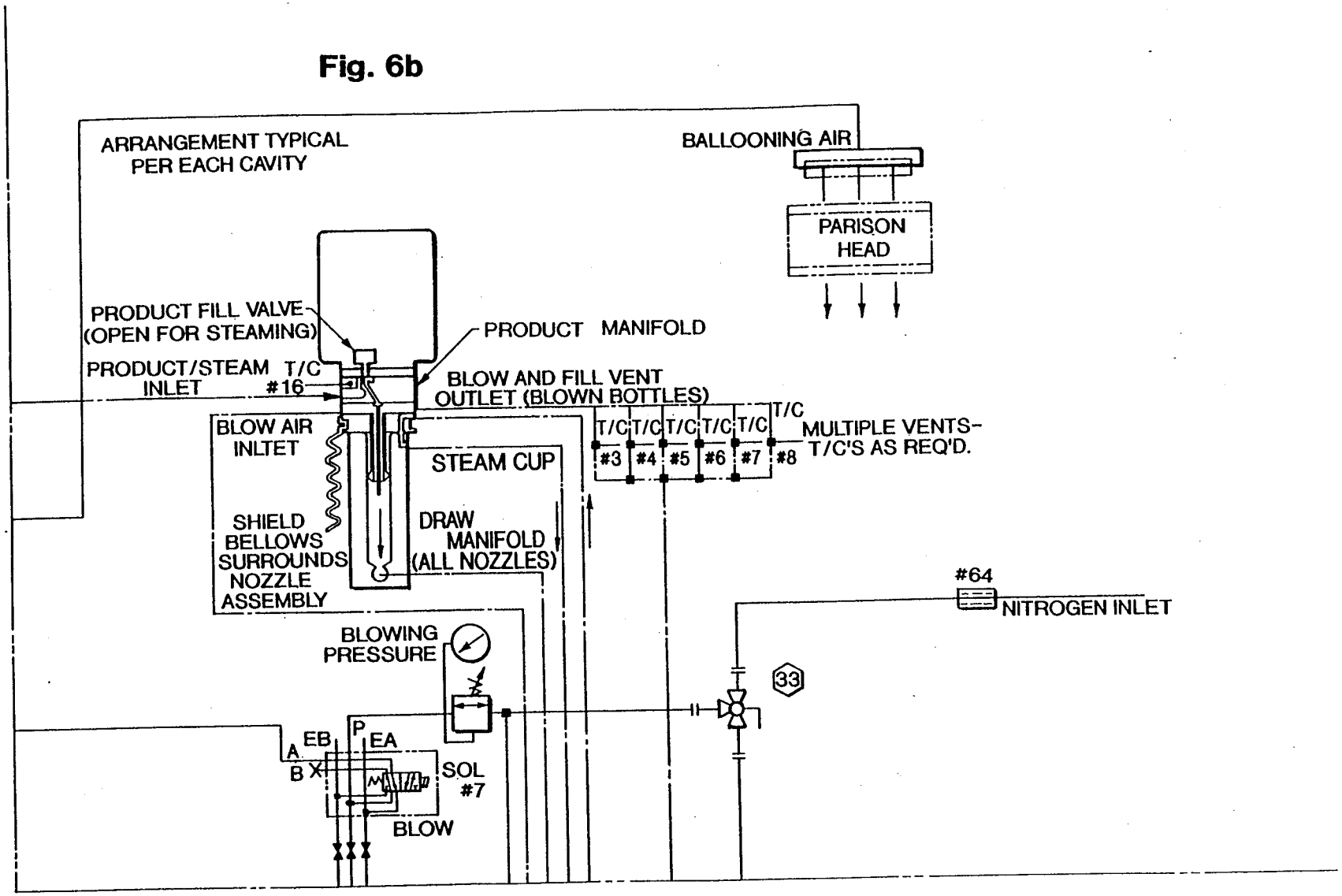
Figure 6C:
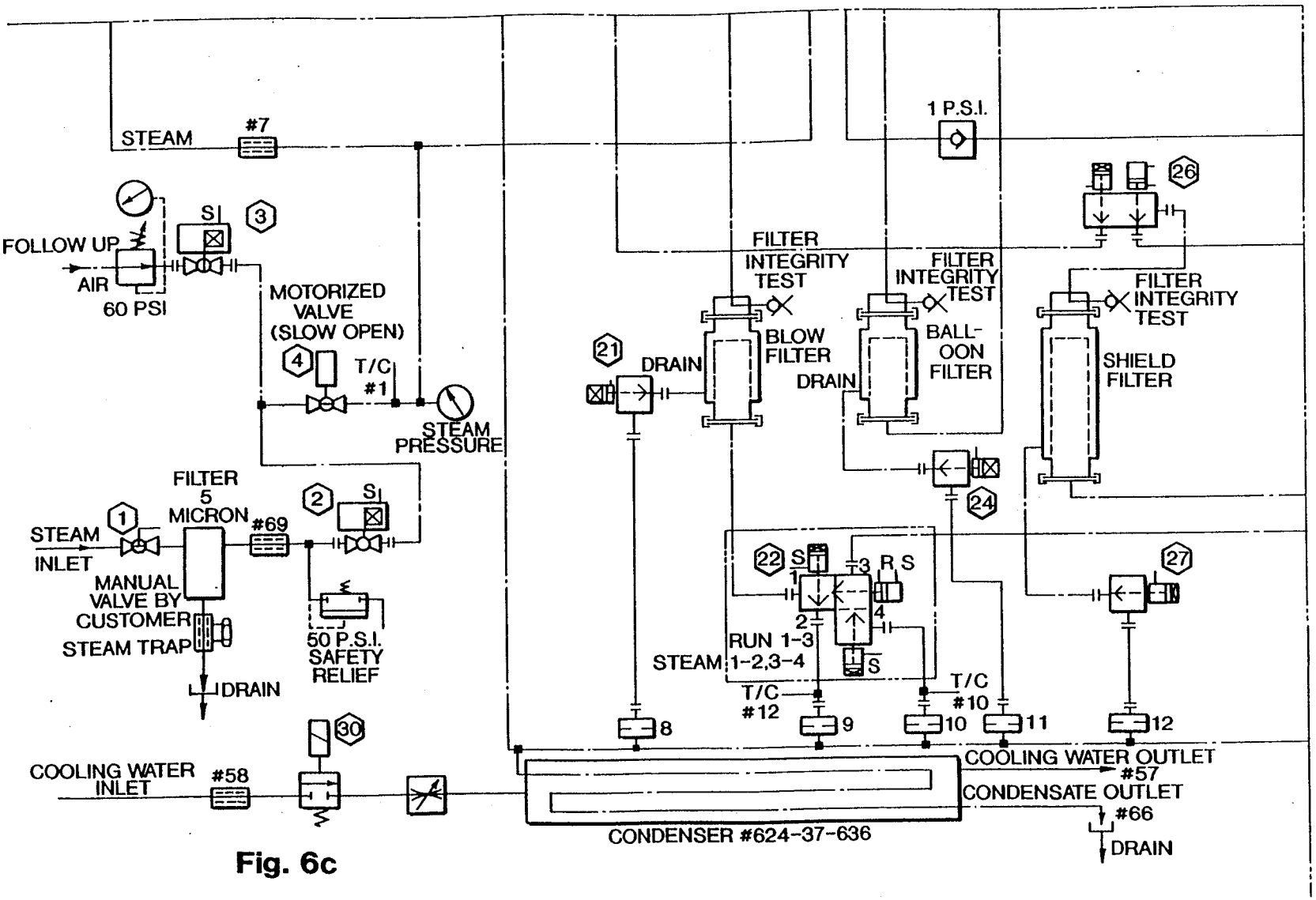
Figure 6D:
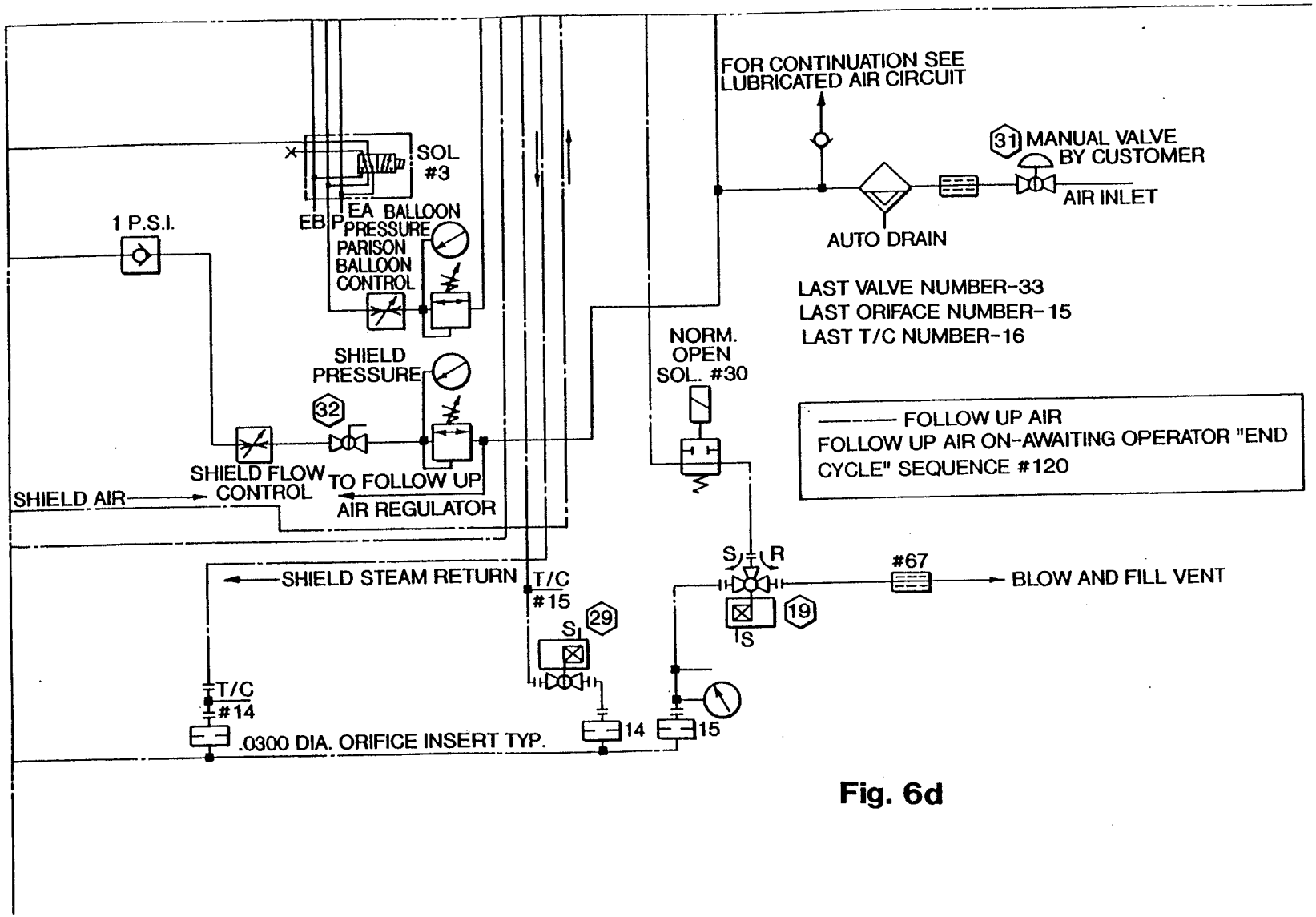

A still further aspect of the method of the present invention is illustrated in FIG. 2 which shows additional operations with respect to the basic sterilizing system previously described with reference to FIG. 1. In particular, the additional operations illustrated in FIG. 2 serve to prevent the occurrence of sub-atmospheric pressures and excessive pressure differentials in the product filling system 216 and process gas supply system 222 following termination of the sterilizing process.

Specifically, when the flow of sterilizing steam to the systems is terminated, the systems begin to cool, and the steam condenses. As explained earlier in detail, this can result in the creation of subatmospheric pressures in the system and lead to the ingress of contaminants carried into the system with ambient atmosphere through leakage paths that may exist.

In addition, some components, especially filters, can be damaged by excessive pressure differentials that may then exist across portions of the systems.

The sterilizing process can be operated as illustrated in FIG. 2 to introduce pressurized gas from the process gas supply 224 into the product filling system 216 and process gas supply system 222. This prevents the internal pressure in the systems from decreasing below the ambient atmospheric pressure as the steam condenses.

The process gas is introduced during cool-down by opening the valve 252 in the process gas supply system inlet line 226. The pressurized gas can then flow through the various components and piping of the process gas supply system 222 and through the components and piping of the product filling system 216. The gas is prevented from entering the steam supply system 242 by the steam inlet valve 260 which has, of course, already been closed to terminate the steam flow.

It is contemplated that the method of pressurizing the liquid packaging machine systems during cool-down following sterilization could also be employed with packaging machines that have only a product filling system and not a process gas supply system. Such a machine would typically be employed to fill previously fabricated containers in a clean room environment, and such a machine could employ hydraulic or electric actuators and would then not be necessarily require a process gas supply system. With such a machine, a special source of gas would have to be provided for pressurizing the product filling system during cool-down of the system following steam sterilization.

It will be appreciated that with a liquid packaging machine 200 having both the product filling system and process gas supply system as illustrated in FIGS. 1 and 2, a special source of air separate from the process gas supply may also be employed following sterilization. In general, however, the machine process gas supply source 224 can be used for supplying the pressurized gas during the cool-down period following sterilization. Since the product filling system 216 and the process gas supply system 222 typically each employ contaminant trapping filters at the upstream (inlet) end of the system, the process gas can be introduced into the systems upstream of the filters (e.g., upstream of the system filters and other components 236 and 238 as illustrated in FIG. 2) so that the pressurization of the downstream components (including piping) is necessarily effected with filtered, contaminant-free gas.

The process gas or sterile gas, which can be introduced into either the product filling system alone or into both the product filling system and a process gas supply system, may be air or other suitable gas (e.g., nitrogen or other inert gas). The gas may be maintained at a substantially constant pressure during the cool-down. In one contemplated mode of operation, the gas pressure is maintained at a pressure sufficiently greater than atmospheric to ensure that the gas flows through all of the components and adequately pressurizes all portions of the system which were subjected to the sterilizing steam. Typically, for those systems that include a filter, the gas pressure must be sufficiently high to break the bubble point on the filter. For example, in one typical liquid packaging ;machine product filling system having a conventional filter, the gas pressure would be maintained at about 80 pounds per square inch gauge, plus or minus 5 pounds per square inch gauge. The gas pressure may be maintained for a predetermined time interval or until at least the most massive component in the systems has cooled to about 100 degrees Fahrenheit. However, the pressurized gas would typically be maintained in the systems until the operator initiates subsequent machine operations or tests.

Other temperature sensors (not illustrated) may be provided in a plurality of locations throughout the piping and components of the product filling system 216 and process gas supply system 222. The control system 274 can receive the signals from the temperature sensors and delay the start of the sterilizing period until all of the temperature sensors indicate the establishment of a predetermined, elevated temperature at those locations. This would ensure that all portions of the system are at a desired sterilizing temperature at the beginning of the timed sterilizing period or interval.

EXAMPLE

An example of the use of the method of the present invention with a specific automatic liquid packaging machine is schematically illustrated in detail in FIGS. 3*a*–3*d*, 4*a*–4*d*, 5*a*–5*d*, 6*a*–6*d*, 7*a*, 7*b*, 8*a*–8*c*, and 9. In these Figures, a thermocouple is designated by "T/C," a time delay relay by "TD," a panel light by "PL," and a pilot valve by "PV." FIG. 9 sets forth a legend for the graphic symbols used in the Figures.

FIGS. 3*a*–3*d* show the machine product filling system and process gas system connected with the sterilizing steam system according to the principles of the present invention. FIGS. 3*a*–3*d* illustrate the machine systems with the valves shown in the normal machine running position. The machine in this example normally operates to form, fill, and seal the container. The process gas system of the machine is used for "ballooning" the parison to prevent parison collapse at the extruder head, for blow molding the container from the parison, for providing a gas shield atmosphere during the blow molding and filling of the container, and for operating certain pneumatic actuators in a lubricated air circuit.

FIGS. 4*a*–4*d* illustrate the sterilization process of the present invention at initial start-up of the steam flow during which time steam is condensing within the initially unheated piping and components.

FIGS. 5*a*–5*d* illustrate the sterilization process after the components and piping have been elevated to the sterilizing temperature following removal of the condensate. In a preferred form of the sterilizing method, the sterilizing steam is supplied at about 30 pounds per square inch gauge.

FIGS. 6a–6d illustrate the cool-down of the systems after the sterilizing steam flow has been terminated and after the systems have been pressurized with air (referred to in the Figures as "follow-up air").

FIGS. 7a and 7b constitute a chart of the main valves in the systems. The chart shows how the valves are operated and at what points during the sterilization process sequence the valves are operated.

Figure 8A:
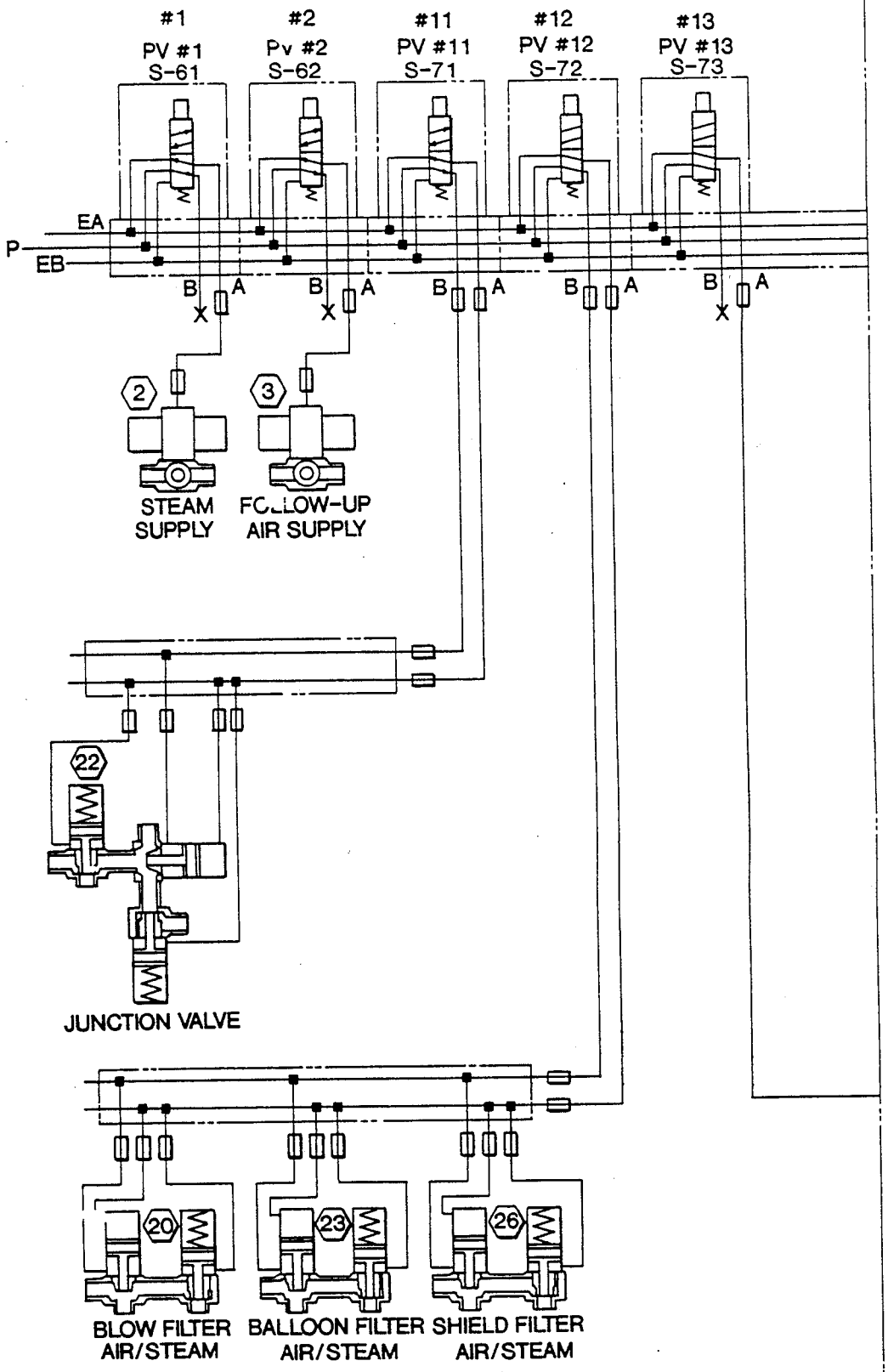
FIG. 8 is a plan of how a large pneumatic diagram has been divided into three smaller diagrams designated FIGS. 8*a*, 8*b*, and 8*c* wherein the FIGS. 8*a*, 8*b*, and 8*c* together illustrate pilot valves which operate the pneumatically actuated main valves.
Figure 8B:
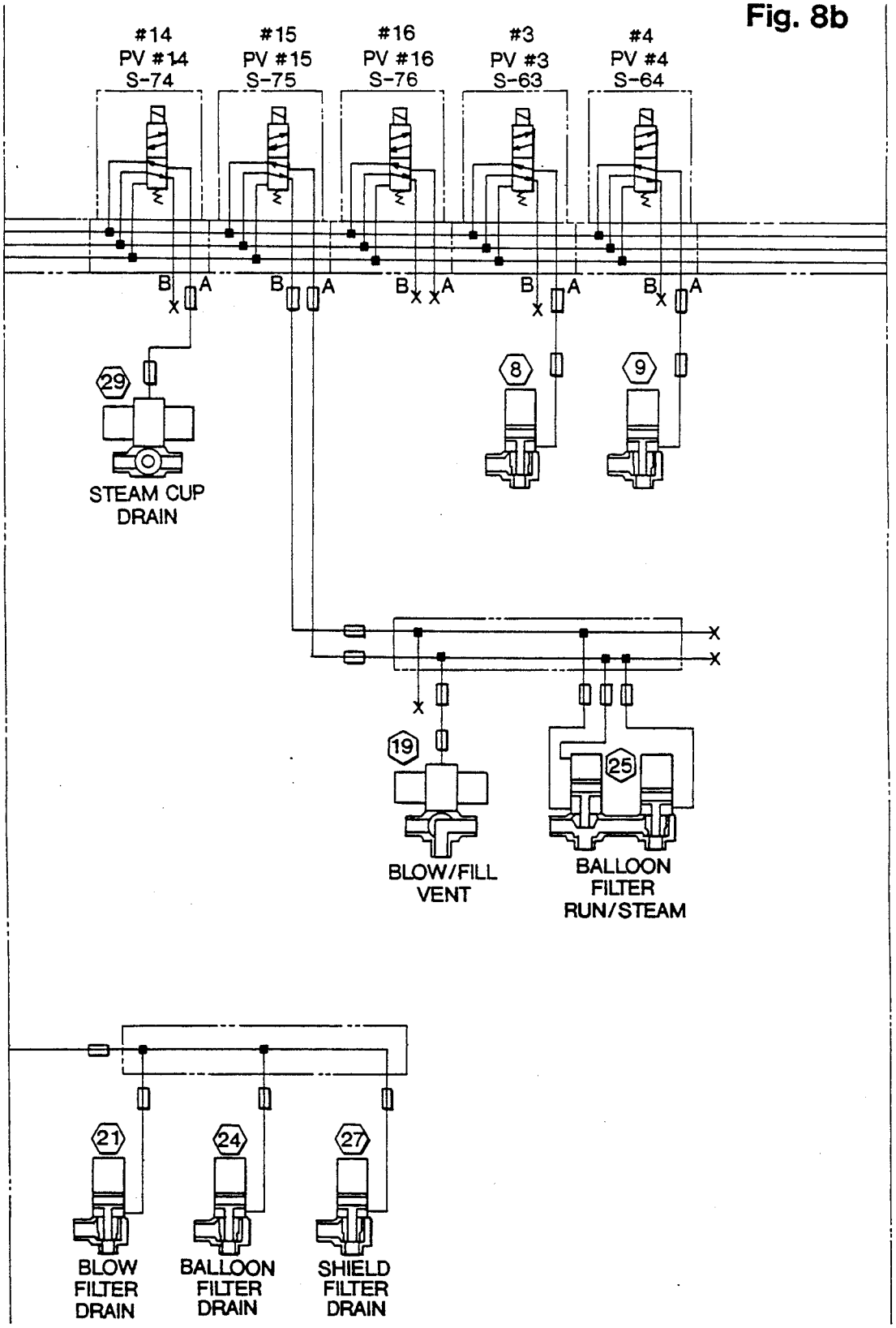
Figure 8C:
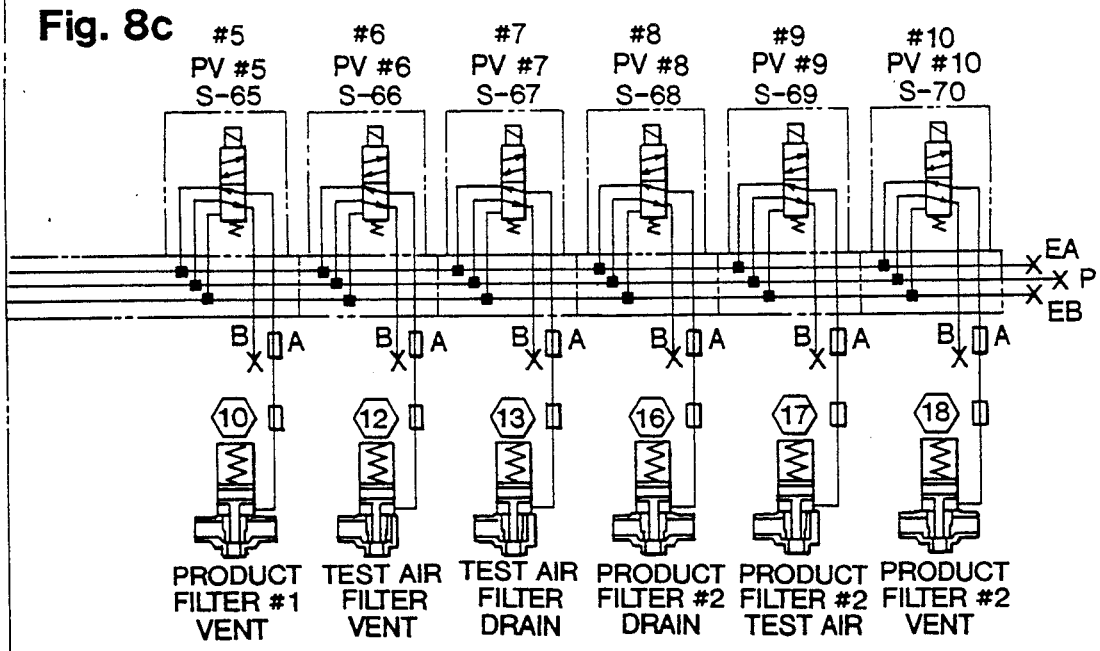
Figure 9:
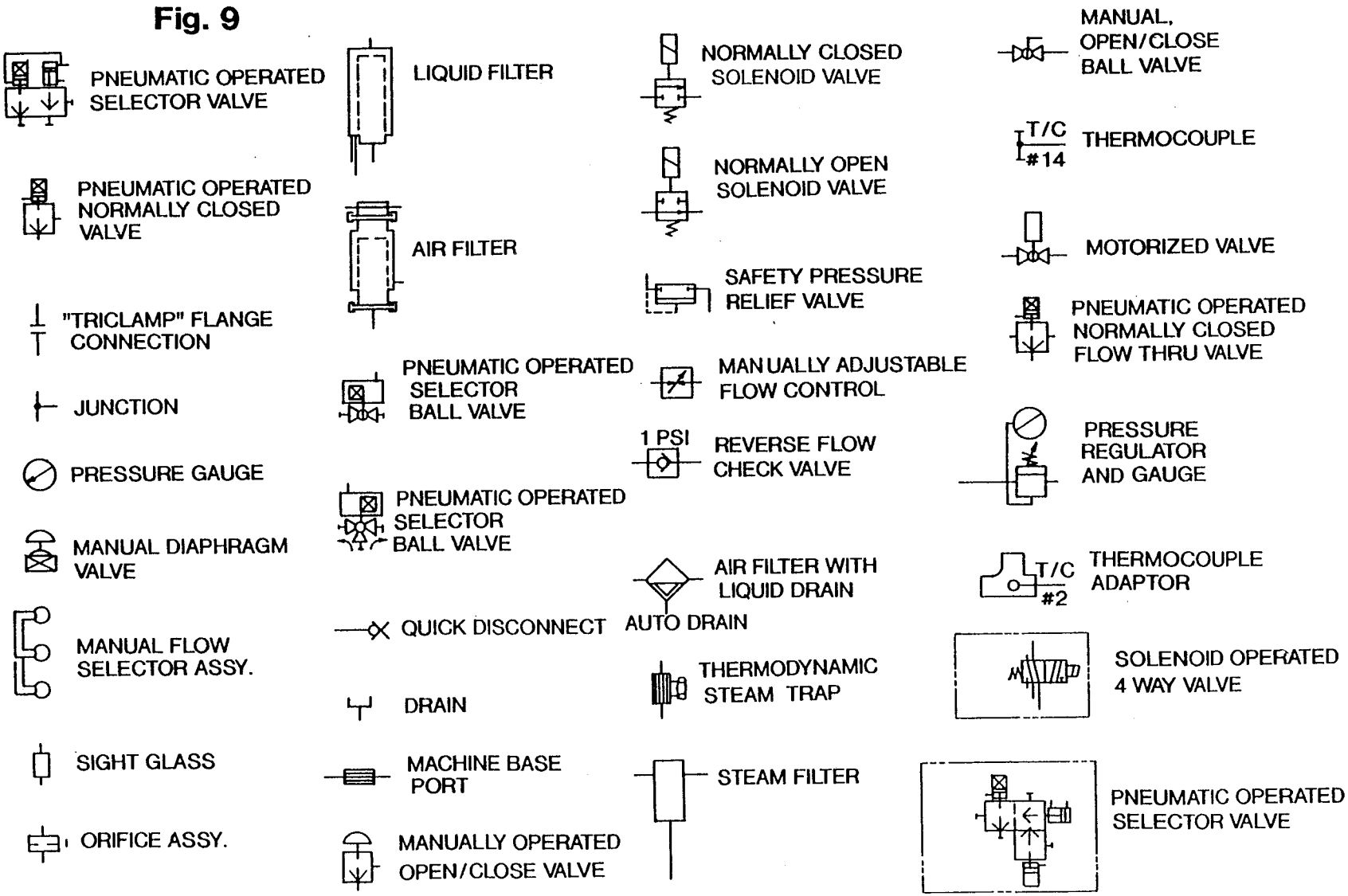
FIG. 9 is a graphic symbol legend for FIGS. 3*a*–3*d*, 4*a*–4*d*, 5*a*–5*d*, 6*a*–6*d*, 7*a*, 7*b*, and 8*a*–8*c*.

FIGS. 8a–8c constitute a pneumatic diagram of the pilot valves which operate the pneumatically actuated main valves.

Presented at the end of this specification, and made a part of this specification, are PROCEDURES A, B, C, D, E, F and G. PROCEDURE A is entitled "Automatic Sterilization Cycle" and sets forth the sterilization sequence for the example illustrated in FIGS. 3a–3d, 4a–4d, 5a–5d, 6a–6d, 7a, and 7b. Each numbered sequence stage sets forth all of the events (e.g., opening or closing of valves, time delay relay operation, actuation of pilot lights, etc.). PROCEDURE B, entitled "General Notes On Automatic Sterilization Cycle," sets forth additional information on the thermocouples and other components referred to in PROCEDURE A.

It is desired to maintain above-atmospheric pressure within the sterilized portions of the machine systems in order to prevent ingress of bacteria and other contaminants. The control system can be arranged to automatically terminate the gas pressurization of the machine systems after the system components have cooled to a selected lower temperature as determined by appropriate temperature sensors. Typically, the gas pressure is maintained in the sterilized systems until the operator of the machine is ready to begin other machine operations, such as filter integrity tests and related operations, which will next be described.

PROCEDURE C, entitled "Product Filter Integrity Test Procedure," sets forth the step-by-step procedure for testing integrity of the filling system product filters.

PROCEDURE D, entitled "Air Filter Integrity Test Procedure," sets forth the step-by-step procedure for testing the integrity of the air filters in the gas or air supply system.

PROCEDURE E, entitled "Air Filter Blow Down Cycle," sets forth a process for automatically blowing down the air filters in the process gas supply system.

PROCEDURE F, which is entitled "Automatic Product Path Blow Down Cycle," sets forth the process for blowing down the product filters in the product filling system.

Finally, PROCEDURE G, entitled "Check List For Machine Running Conditions," sets forth steps to be taken to ensure that the machine is in a condition ready for automatic operation to form, fill, and seal the containers.

PROCEDURE A

AUTOMATIC STERILIZATION CYCLE

| SEQUENCE # | EVENT |
|---|---|
| 010 | Machine in initial conditions: |
| | Filter elements in place |
| | Steam cup on |
| | Air supply on |
| | Machine power on |
| | Product fill valves open (push button PB1 on front of machine) |
| | Cooling water supply on |

-continued

AUTOMATIC STERILIZATION CYCLE

| SEQUENCE # | EVENT |
|---|---|
| | 40 psi steam supply at machine |
| | Product swing elbow to "Steam" position |
| | Steam/Air supply valve #5 open |
| | Product line valves #'s 7 & 14 open |
| | Bioburden sample port valve #11 closed |
| | Product filter #2 drain valve #16 swing elbow clamped in "Steam" position |
| | Steam barrier valve #15 closed |
| | All automatic valves in "Run" position (pilot valves not energized) |
| | Shield air supply valve #32 closed |
| | Kaye Digistrip recorder/controller connected and all thermocouples are indicating proper temperature |
| | All pilot valves off |
| | Follow up air pressure set to 80 psi |
| 020 | Operator opens steam supply valve #1 |
| 030 | Operator pushes SPBI push button to "Start" |
| | Automatic Sterilization Cycle |
| | Cooling water inlet solenoid operated valve #30 on to open flow to condenser |
| | All automatic valves shift to "Steam" position, pilot valves #3, 4, 5, 6, 7, 8, 9, 10, 11, 12, 13, 14 & 15 "ON" |
| | "Sterilization In Process" warning light, SPL1 - on |
| | Start S-TD1, 30 seconds |
| 040 | S-TD1 times out |
| | Steam inlet valve #2 opens, PV1 - ON |
| | Motorized valve #4 opens slowly (2 minutes) |
| | "Heat Up" Light, SPL2 - on |
| 050 | When T/C #2 = 220 degrees F. (DO#1) |
| | Close product filter vent valves #'s 10 & 18, PV5 & PV10 - off |
| | Close integrity test air filter drain valve #13, PV7 - off |
| 060 | When T/C #15 = 220 degrees F. (DO#2) |
| | Close steam cup drain valve #29, PV14 - off |
| 070 | When T/C #'s 1, 2, 3, 4, 5, 6, 7, 8, 9, 10, 11, 12, 13, 14 & 15 are all over 250 degrees F., and T/C #16 is over xxx degrees F. then start timer S-TD2 (30 minutes). (DO#3) |
| | "Heat Up" Light SPL2 - off |
| | "Exposure" Light SPL3 - on |
| 080 | When S-TD2 = 30 minutes, then |
| | Steam inlet valve #2 closes, PV1 - off |
| | Motorized valve #4 closes |
| | Start S-TD3 (30 seconds) |
| 090 | S-TD3 times out |
| | Follow up air inlet valve #3 opens, PV2 - on |
| | Motorized valve #4 opens (2 minutes) |
| | Open steam cup drain valve #29, PV14 - on |
| | Start S-TD4 (2 minutes) |
| | "Exposure" Light SPL3 - off |
| | "Follow Up Air On" Light SPL4 - on |
| 100 | S-TD4 times out |
| | Close product filter #1 drain valve #8, PV3 - off |
| | Close blow filter drain valve #21, PV13 - off |
| | Close balloon filter drain valve #24, PV13 - off |
| | Close shield filter drain valve #27, PV13 - off |
| | Start S-TD5 (30 seconds) |
| 110 | S-TD5 times out |
| | Close product filter #2 drain valve #16, PV8 - off |
| | Start S-TD6 (1 minute) |
| 120 | S-TD6 times out |
| | Close steam cup drain valve #29, PV14 - off |
| | Cooling water solenoid operated inlet valve #30 off to close flow to condenser |
| 130 | Follow up air flow remains on until T/C #16 cools down to a preset temperature (DO#4) or operator pushes "End Cycle" button PB2. |
| | Follow up air inlet valve #3 closes, PV2 - off |
| | Motorized valve #4 closes |
| | Start S-TD7 (30 seconds) for pressure bleed |
| 140 | S-TD7 times out |
| | Close product filter #1 test air valve #9, PV4 - off |
| | Close product filter #2 test air valve #17, PV9 - off |
| | Close test air filter vent valve #12, PV6 - off |

-continued

| AUTOMATIC STERILIZATION CYCLE | |
|---|---|
| SEQUENCE # | EVENT |
| | Blow filter air/steam valve #20 to "Run", PV12 - off |
| | Balloon filter air/steam valve #23 to "Run", PV12 - off |
| | Shield filter air/steam valve #26 to "Run", PV12 - off |
| | Balloon filter run/steam valve #25 to "Run", PV15 - off |
| | Blow & fill vent valve #19 to "Run", PV15 - off |
| | Junction valve #22 to "Run", PV11 - off |
| | "Sterilization In Process" warning light, SPL1 - off |
| | "Follow Up Air On" Light SPL4 - off |

PROCEDURE B

GENERAL NOTES ON AUTOMATIC STERILIZATION CYCLE

1. THERMOCOUPLE LIST:

| Number | Location |
|---|---|
| T/C #1 | Steam/Air Inlet to Machine |
| T/C #2 | Product Line After 2nd Product Filter |
| T/C #3 | Vent Line From Fill Nozzle Ass'y. |
| T/C #4 | Vent Line From Fill Nozzle Ass'y. |
| T/C #5 | Vent Line From Fill Nozzle Ass'y. |
| T/C #6 | Vent Line From Fill Nozzle Ass'y. |
| T/C #7 | Vent Line From Fill Nozzle Ass'y. |
| T/C #8 | Vent Line From Fill Nozzle Ass'y. |
| T/C #9 | Combined Blow/Fill Vent From Nozzle Ass'y. |
| T/C #10 | Blow Line From Nozzle Ass'y. |
| T/C #11 | Integrity Test Air Filter Vent |
| T/C #12 | Blow Filter Outlet |
| T/C #13 | Balloon Filter Outlet |
| T/C #14 | Shield Filter Outlet |
| T/C #15 | Steam Cup Condensate Drain |
| T/C #16 | Fill Nozzle Assembly Block (metal) |

2. KAYE DIGISTRIP FUNCTIONS:

Record and log time and temperature of all 16 Thermocouple Inputs.

Provide following Digistrip Outputs (DO#) consisting of switch contact closures to Maco 8000 control:

DO#1 (Sequence #050)—contact closure when T/C #2=220 degrees F.

DO#2 (Sequence #060)—contact closure when T/C #15=220 degrees F.

DO#3 (Sequence #070)—contact closure when T/C #1 thru #14 are all over 250 degrees F. If temperature should go below 245 degrees F. for more than three minutes, then contact DO#3 shall open to automatically abort the cycle.

DO#4 (Sequence #130)—contact closure when T/C #16 has cooled down to 100 degrees F.

PROCEDURE C

PRODUCT FILTER INTEGRITY TEST PROCEDURE

The machine should be in initial conditions as specified in Auto-Sterilization Cycle Sequence #010. Filters will be air purged and wetted with product. Integrity test will be pressure hold and bubble point pressure performed by Palltronic #FFE03 Test Instrument.

1. open steam supply valve #15 to allow steam to blow thru valve #16 sanitizing the outlet of product filter #2 drain.

2. Check that product fill valves are open.

3. Check that product supply valve #6 is closed.

4. Close steam supply valve #5.

5. Switch product swing elbow to "Product" position.

6. Turn product supply pump on.

7. Slowly open product supply valve #6.

8. Allow product to flow thru filters and fill nozzle assembly into drain trough.

9. When flow is established, press SPB10 to open valve #10 and purge air from product filter #1.

10. When product flow is seen thru sight glass, press SPB10 to close valve #10.

11. Press SPB18 to open valve #18 and purge air from product filter #2.

12. When product flow is seen thru sight gauge, press SPB18 to close valve #18.

13. Stop product flow, close product supply valve #6.

Air has been purged from the product filters and the product filter elements should be thoroughly wetted with product. To proceed with integrity test of product filter #1:

14. Connect Palltronic test unit to machine. Plug in air supply hose and power cord. Check that unit has correct test parameters for filter type and product programmed in.

15. Connect Palltronic test hose into top of integrity test air filter.

16. Close product valve #7.

17. Check that valve #14 is open.

18. Close steam supply valve #15.

19. Disconnect swing fitting on exit of valve #16 and position over drain in "Test" position.

20. Slightly open steam valve #15 to flow stream thru valve #16.

21. Press PB16 to open drain valve #16.

22. Press PB9 to open valve #9.

23. Start Palltronic test cycle. Product filter #1 is pressurized and tested thru integrity test air filter. The downstream side of the filter element is open to atmosphere thru sterile drain valve #16.

24. At conclusion of test, press SPB16 to close valve #16.

25. Close steam valve #15

26. Reconnect swing fitting on exit of valve #16 to "Steam" position.

27. Press SPB9 to close valve #9.

To proceed with the integrity test of product filter #2:

28. Close product valve #14.

29. Check that product fill valves are open.

30. Press SPB17 to open valve #17.

31. Start Palltronic test cycle. Product filter #2 is pressurized and tested thru integrity test air filter. The downstream side of the filter element is open to atmosphere thru the product fill nozzles.

32. At conclusion of test, press SPB17 to close valve #17.

33. Open product valve #14.

34. Disconnect Palltronic test hose from top of integrity test air filter.

PROCEDURE D

AIR FILTER INTEGRITY TEST PROCEDURE

The machine should be in initial conditions as specified in Auto Sterilizing Cycle Sequence #010. The filters will be water wetted and integrity tested by a Palltronic #FFE03 Test Instrument.

1. Check that shield air supply #32 is closed.
2. Check that blow air solenoid valve #7 is off (machine control).
3. Check that balloon air solenoid valve #3 is off (machine control)

The filters will be wetted by water from a 5 gallon pressurized tank having a water shutoff valve with hose attachment to fit the integrity test port at the top of the filter housing. The tank should be half filled with water and then pressurized with approximately 30 psi air.

4. Plug water supply hose into test port on top of blow air filter housing.
5. Open water valve momentarily to fill filter housing and wet filter.
6. Disconnect supply hose.
7. Repeat Steps 6, 7 and 8 for balloon filter and shield filter.
8. Check that Palltronic Test Unit has correct test parameters for filter type programmed in.
9. Connect Palltronic test hose into top of blow filter housing.
10. Start Palltronic test cycle. The blow filter is pressurized and tested. The downstream side of the filter element is open to atmosphere thru the fill nozzle assembly.
11. At conclusion of test, repeat procedure for the balloon and shield filters. The downstream side of these filters are open thru the parison head and nozzle shield respectively.
12. When all tests are completed, disconnect Palltronic test hose from filter.

PROCEDURE E

AIR FILTER BLOW DOWN CYCLE (AFTER INTEGRITY TESTING)

This sequence is used for blowing integrity test water out of the machine air circuits and for drying the air filter elements preparatory to running the machine. The cycle is run in two steps. The first step is run with the nozzle steam cups in place to allow the water to be purged thru the condensate drain. The second step is run with the steam cups removed from the nozzles to provide a high flow rate of air for drying the filter elements.

AIR FILTER BLOW DOWN CYCLE STEP #1

(1) Check For Following:
Steam Cup Mounted On Nozzle Assembly, LS28 Steam Cup Interlock Switch Is Open
Product Fill Valves—CLOSED
Valve #5 (Steam/Air Supply To Product Filters) Is Closed (2) Operator Presses SPB5 Pushbutton "AIR FILTER BLOW DOWN" To Start Cycle:
Valves #20, #23 And #26 Switch To Steam Position, PV12—ON
Open Steam Cup Drain Valve #29, PV14—ON
Shift Blow And Fill Vent Valve #19 To "STEAM" And Shift Balloon Filter Run/Steam Valve #25 to "STEAM" PV15—ON
Start S-TD8 (15 Seconds)

(3) S-TD8 Times Out:
Valve #3 Opens, PV2—ON
Motorized Valve #4 Opens Slowly (2 Minutes)
Start S-TD9 (3 Minutes)

Follow up air at 80 PSI is slowly admitted to air filter system. This air which exceeds bubble point pressure will flow thru air filters forcing integrity test water out. The water in blow filter will flow to the nozzle assembly, thru the steam cup and out the condensate drain thru orifices #14 and #15. The water in the balloon filter will flow thru valve #25 and out the condensate drain thru orifice #7. The water in the shield air filter will flow to the nozzle assembly, thru the steam cup and out the condensate drain thru orifice #13.

(4) S-TD9 Times Out Or Operator Interrupts Cycle By Again Pressing S-PB5 To End Cycle
Valve #3 Closes, PV2—OFF
Motorized Valve #4 Closes
Start S-TD10 (15 seconds)

(5) S-TD10 Times Out:
Valves #20, #23, And #26 Switch To "RUN" Position, PV12—OFF
Close Steam Cup Drain Valve #29, PV14—OFF
Shift Blow And Fill Vent Valve #19 to "RUN", And Shift Balloon Filter Run/Steam Valve #25 to "RUN", PV15—OFF
"MISSING STEAM CUP" Light PL11—ON

AIR FILTER BLOW DOWN CYCLE STEP #2

This sequence provided an air filter blow down cycle without the steam cup mounted on the nozzle assembly and enables a high flow rate of air for drying the filters. The sequence is automatically selected when the steam cup is mounted in the storage position on the front of the machine and the steam cup interlock switch #LS28 is actuated.

(1) Operator Removes Steam Cup From Nozzle Assembly And Mounts In Storage Position:
Steam Cup Switch LS28 Is Actuated
"MISSING STEAM CUP" Light PL11—OFF (2) Check That Valve #5 (Steam/Air Supply To Product Filters) Is Closed (3) Operator Presses SPB5 Push button "AIR FILTER BLOW DOWN" To Start Cycle:
Valves #20, #23 And #26 Switch To Steam Position, PV12—ON
Start S-TD8 (15 Seconds)

(4) S-TD8 Times Out:
Valve #3 Opens, PV2—ON
Motorized Valve #4 Opens Slowly (2 Minutes)
Start S-TD9A (Approximately 20 Minutes For Filter Drying—Determined By Experimentation.)

Follow up air at 80 PSI is slowly admitted to air filter system. This air which exceeds bubble point pressure will flow thru air filters to dry them out. Air thru blow air filter will pass out nozzle assembly. Air thru balloon air filter will pass thru parison head. Air thru shield air filter will pass thru nozzle shield.

(5) S-TD9A Times Out Or Operator Interrputs Cycle By Again Pressing SPB5 Pushbutton To End Cycle.
Valve #3 Closes, PV2—OFF
Motorized Valve #4 Closes
Start S-TD10 (15 Seconds)

(6 S-TD10 Times Out:
Valves #20, #23 And #26 Switch To "RUN" Position, PV12—OFF.

PROCEDURE F

AUTOMATIC PRODUCT PATH BLOW DOWN CYCLE

This sequence will automatically blow out the product filters and fill nozzle assembly and can be used for clearing the product piping of water or product.

Initial conditions:
Product supply valve #6 closed
Product swing elbow to "steam" position
Steam/air supply valve #5 open
Product valves #7 and #14 open
Steam cup on
Product fill valves open 1. Operator presses SPB4 pushbutton "product filter blow down" to start cycle:
Valve #3 opens, PV2—on
Motorized valve #4 opens slowly (2 minutes)
Valve #29 steam cup drain opens, PV14—on
Start S-TD11 (approximately 10 minutes, determine by experimentation.)

Follow up air at 80 psi is slowly admitted to the product filters and filling system. This air which exceeds bubble point pressure will flow thru the filters and out the fill nozzle assembly.

2. S-TD11 times out or operator interupts the cycle by again pressing SPB4 pushbutton to end the cycle.
Valve #3 closes, PV2—off
Motorized valve #4 closes
Valve #29 steam cup drain closes, PV14—off

PROCEDURE G

CHECK LIST FOR MACHINE RUNNING CONDITIONS

1. Automatic sterilization cycle run per previous procedure.
2. Product filter integrity test procedure completed.
3. Air filter integrity test procedure completed.
4. Air filter blowdown and drying procedure completed.
5. Steam cup removed.
6. Nozzle drain trough removed.
7. Air supply on.
8. Machine power on.
9. Cooling water supply on.
10. Steam inlet valve #1 closed.
11. Steam supply valve #5 closed.
12. Product swing elbow assembled in "Product" position.
13. Product line valves #7 and #14 open.
14. Bioburden sample port valve #11 closed.
15. Product filter #2, drain valve #16 swing elbow assembled in "Steam" position.
16. Steam barrier valve #15 closed.
17. Blowing, ballooning and shield pressure regulators set to proper running pressures.
18. Parison ballooning flow controls set to proper running settings.
19. Shield air supply valve #32 open and flow control set to proper shield air flow volume.
20. All automatic sterilization valves in run position with all pilot valves de-energized. All indicating pilot lights should be off.
21. Palltronic test hose disconnected from filters and unit power turned off.
22. Kaye Digistrip turned off.
23. Kaye strip charts and Palltronic printouts accumulated and filed.

The machine should now be in sterilized condition and ready for automatic operation. See "Start Up" section of manual for procedure.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A method for steam sterilization of product components defining fill product passages and of process gas components defining process gas passages in a container filling machine, said method comprising the steps of:
(a) supplying a common source of sterilizing steam;
(b) simultaneously directing some of said steam from said common source into said product passages and some of said steam from said common source into said process gas passages in a single pass; and
(c) maintaining said steam in said product and process gas passages generally concurrently for a time period sufficient to sterilize said product components and process gas components.

2. A method for steam sterilization of product components defining fill product passages and of process gas components defining process gas passages in a container filling machine wherein one of said components has the relatively largest mass as compared to the other components, said method comprising the steps of:
(a) supplying a common source of sterilizing steam;
(b) directing said steam from said common source concurrently into said product passages and into said process gas passages in a single pass;
(c) maintaining said steam in said product and process gas passages for a time period sufficient to sterilize said product and process gas components;
(d) sensing the temperature of said one component having the largest mass; and
(e) the additional step, after a predetermined first temperature has been sensed in said one component, of terminating steps (b) and (c) at the end of a predetermined time period following the sensing of said predetermined first temperature.

3. A method for steam sterilization of product components defining fill product passages and of process gas components defining process gas passages in a container filling machine, said method comprising the steps of:
(a) supplying a common source of sterilizing steam;
(b) directing said steam from said common source concurrently into said product passages and into said process gas passages in a single pass;
(c) maintaining said steam in said product and process gas passages for a time period sufficient to sterilize said product and process gas components; and
(d) terminating step (c) and introducing a sterile gas into said product and process gas passages as said product and process gas components cool and cause steam to condense therewithin so as to maintain the internal pressure in said product and process gas passages at least at ambient atmospheric pressure.

4. The method in accordance with claim 3 including the further steps of (1) sensing the temperature in one of said product and process gas components, (2) performing step (c) for a time period beginning with the sensing of a predetermined first temperature, and (3) terminating said step of introducing said sterile gas after sensing in said one component a predetermined second temperature lower than said predetermined first temperature.

5. The method in accordance with claim 3 in which said step of introducing said sterile gas includes maintaining said sterile gas in said product and process gas passages at above-atmospheric pressure.

6. The method in accordance with claim 3 in which said step of introducing said sterile gas includes first directing a non-sterile gas through a sterilizing filter into product and process gas passages.

7. The method in accordance with claim 1 in which said components defining said fill product passages are part of a product filling system, in which said process gas components defining said process gas passages are part of a process gas supply system, and in which step (b) includes (1) opening a communicating passage between said product filling system and said process gas supply system and (2) directing a flow of said sterilizing steam from said common source into said communicating passage for supplying both of said systems concurrently.

8. A method for steam sterilization of components of a container filling machine, said method comprising the steps of:

(a) providing a source of sterilizing steam to flow through passages defined by said components to heat said components to a sterilizing temperature for a period of time to sterilize said components; and (b) introducing a sterile gas into said passages as said components cool and cause said steam to condense therewithin so as to prevent the internal pressure in said passages from decreasing below the ambient atmospheric pressure.

9. The method in accordance with claim 8 in which step (a) includes causing said stem to flow through said passages at above-atmospheric pressure.

10. The method in accordance with claim 8 in which step (a) includes draining condensate from said passages.

11. The method in accordance with claim 8 in which said method includes terminating step (a) after said components have been sterilized and in which step (b) includes introducing said gas after step (a) has been terminated.

12. The method in accordance with claim 8 in which step (b) includes introducing said gas by first directing a non-sterile gas through a sterilizing filter into said passages.

13. A method for steam sterilization having a plurality of components wherein one of said components has the relatively largest mass as compared to the other components of a container filling machine, said method comprising the steps of:

(a) supplying sterilizing steam to the components of said machine to flow through passages defined by said components to heat said components to a sterilizing temperature;

(b) sensing a temperature of said one component having the relatively largest mass; and (c) terminating step (a) after a predetermined first temperature has been sensed in step (b) and maintained for a period of time to sterilize said components.

14. The method in accordance with claim 13 in which step (a) includes draining condensate from said passages.

15. The method in accordance with claim 13 in which step (a) includes supplying said steam for a predetermined time period following the sensing of said predetermined first temperature; and step (c) includes terminating step (a) at the end of said predetermined time period.

16. The method in accordance with claim 13 including the further step (d) of introducing sterile gas into said passages as said components cool and cause steam to condense therewithin so as to maintain the internal pressure in said passages at least at the ambient atmospheric pressure.

17. The method in accordance with claim 16 including the further step (e) of terminating step (d) after sensing in step (b) a predetermined second temperature lower than said predetermined first temperature.

18. The method in accordance with claim 16 in which step (d) includes first directing a non-sterile gas through a sterilizing filter into said passages.

19. A method for steam sterilization of components of a container filling machine, said method comprising the steps of:

(a) supplying sterilizing steam to the components of said machine to flow through passages defined by said components to heat said components to a sterilizing temperature;

(b) sensing a temperature of one of said components; and (c) terminating first step (a) after a predetermined temperature has been sensed in step (b) and maintained for a period of time to sterilize said components.

20. A method for steam sterilization of components of a container filling machine, said method comprising the steps of:

(a) supplying sterilizing steam to the components of said machine to flow through passages defined by said components to heat said components to a sterilizing temperature;

(b) sensing a temperature of the component having the relatively largest mass as compared to the other components;

(c) terminating step (a) after a predetermined temperature has been sensed in step (b) and maintained for a period of time to sterilize said components; and (d) introducing sterile gas into said passages as said components cool and cause steam to condense therewithin so as to prevent the internal pressure in said passages from decreasing below the ambient atmospheric pressure.

* * * * *

UNITED STATES PATENT AND TRADEMARK OFFICE

CERTIFICATE OF CORRECTION

PATENT NO. : 4,989,649

DATED : February 5, 1991

INVENTOR(S) : Gerhard H. Weiler et al.

It is certified that error appears in the above-identified patent and that said Letters Patent is hereby corrected as shown below:

In the ABSTRACT, line 5, "unitl" should be -- until --.

Col. 1, line 23, "aboveidentified" should be -- above-identified --.

Col. 1, line 24, "packing" should be -- packaging --.

Col. 1, line 26, "nd" should be -- and --.

Col. 7, line 20, "filing" should be -- filling --.

Col. 7, line 56, "filing" should be -- filling --.

Col. 9, line 16, "subatmospheric" should be -- sub-atmospheric --.

Col. 9, line 47, after "not" delete -- be --.

Col. 10, line 15, delete the semicolon (;).

Col. 16, line 24, "provided" should be -- provides --.

Signed and Sealed this

Fourth Day of August, 1992

*Attest:*

DOUGLAS B. COMER

*Attesting Officer*

*Acting Commissioner of Patents and Trademarks*